US010569300B2

(12) United States Patent
Hoshi

(10) Patent No.: US 10,569,300 B2
(45) Date of Patent: Feb. 25, 2020

(54) LOW-NOISE ULTRASONIC WAVE FOCUSING APPARATUS

(71) Applicant: PIXIE DUST TECHNOLOGIES, INC., Minato-ku, Tokyo (JP)

(72) Inventor: Takayuki Hoshi, Nagoya (JP)

(73) Assignee: PIXIE DUST TECHNOLOGIES, INC., Minato-Ku, Tokyo (JP)

( * ) Notice: Subject to any disclaimer, the term of this patent is extended or adjusted under 35 U.S.C. 154(b) by 318 days.

(21) Appl. No.: 15/319,725

(22) PCT Filed: Jun. 15, 2015

(86) PCT No.: PCT/JP2015/067206
§ 371 (c)(1),
(2) Date: Dec. 16, 2016

(87) PCT Pub. No.: WO2015/194510
PCT Pub. Date: Dec. 23, 2015

(65) Prior Publication Data

US 2017/0144190 A1 May 25, 2017

(30) Foreign Application Priority Data

Jun. 17, 2014 (JP) ..... 2014-123867

(51) Int. Cl.
*B06B 1/02* (2006.01)
*H04R 1/40* (2006.01)

(52) U.S. Cl.
CPC ..... *B06B 1/0238* (2013.01); *H04R 1/40* (2013.01); *H04R 1/403* (2013.01); *H04R 2217/03* (2013.01)

(58) Field of Classification Search
CPC ..... B06B 1/0238; H04R 1/40; H04R 1/403; H04R 2217/03
See application file for complete search history.

(56) References Cited

U.S. PATENT DOCUMENTS

2008/0009741 A1* 1/2008 Hyuga ..... A61B 8/12 600/459
2015/0073729 A1* 3/2015 Borigo ..... G01N 29/2412 702/39

FOREIGN PATENT DOCUMENTS

JP 62-284646 A 12/1987
JP 9-91757 A 4/1994
(Continued)

OTHER PUBLICATIONS

Ultrasonic device, probe, electronic device and Diagnostic Apparatus JP 2013208163 Nakamura (Year: 2013).*
(Continued)

*Primary Examiner* — Bryan P Gordon
(74) *Attorney, Agent, or Firm* — Buchanan Ingersoll & Rooney PC

(57) ABSTRACT

The present invention reduces noise generated by a phase change in an ultrasonic wave focusing apparatus that changes an ultrasonic wave focal point within a space by changing the phase of vibration of a plurality of ultrasonic transducers. When inputted position coordinates within a three-dimensional space are changed, the ultrasonic wave focusing apparatus calculates a target time lag Tnew that allows ultrasonic waves outputted from the ultrasonic transducers to form a focal point at the changed position coordinates X1, Y1, Z1. The ultrasonic wave focusing apparatus then examines the ultrasonic transducers to locate a particular ultrasonic transducer that outputs an ultrasonic wave whose time lag Ttmp differs from the target time lag Tnew, and changes the phase of the outputted ultrasonic wave to a target phase in multiple steps (steps 140 and 150).

10 Claims, 16 Drawing Sheets

(56) References Cited

FOREIGN PATENT DOCUMENTS

| | | | |
|---|---|---|---|
| JP | 11-226046 | A | 8/1999 |
| JP | 2001-62928 | A | 3/2001 |
| JP | 2007-319553 | A | 12/2007 |
| JP | 2013-208163 | A | 10/2013 |
| JP | 2014-143994 | A | 8/2014 |

OTHER PUBLICATIONS

Ultrasonic treatment apparatus for treatment of tumor in urinary system has system controller which controls RF amplifier and stage , for continuous irradiation of ultrasonic wave for treatment JP 11226046 Fujimoto (Year: 1999).*

English language translation of International Preliminary Report on Patentability (PCT/IB/373), with Written Opinion, dated Dec. 20, 2016, by the Japanese Patent Office as the International Searching Authority for International Application No. PCT/JP2015/067206 (6 pgs).

International Search Report (PCT/ISA/220) dated Sep. 1, 2015, by the Japanese Patent Office as the International Searching Authority for International Application No. PCT/JP2015/067206.

Written Opinion (PCT/ISA/220) dated Sep. 1, 2015, by the Japanese Patent Office as the International Searching Authority for International Application No. PCT/JP2015/067206.

T. Hoshi, "Theory and Implementation of Compact Ultrasonic Wave Focusing Apparatus", Division C of the Institute of Electrical Engineers of Japan, Technical Committee of Perception Information, Enhancement Cooperative Study Committee of Tactile Devices, First Seminar Data, Feb. 27, 2013, pp. 1-6.

Office Action (Notification of Reasons for Rejection) dated Aug. 21, 2018, by the Japanese Patent Office in corresponding Japanese Patent Application No. 2016-529339 and an English Translation of the Office Action. (5 pages).

* cited by examiner

LOW-NOISE ULTRASONIC WAVE FOCUSING APPARATUS

TECHNICAL FIELD

The present invention relates to an ultrasonic wave focusing apparatus for focusing ultrasonic waves at a focal point.

BACKGROUND ART

A technology of an ultrasonic wave focusing apparatus is disclosed by the inventors of the present invention (refer to Non-Patent Literature 1). This ultrasonic wave focusing apparatus, focuses the ultrasonic waves outputted from a plurality of ultrasonic transducers at a focal point, and changes the focal point within a three-dimensional space by changing the phase of vibration of each ultrasonic transducer.

CITATION LIST

Non-Patent Literature

[NPL 1]
Takayuki Hoshi, Theory and Implementation of Compact Ultrasonic Wave Focusing Apparatus, Division C of The Institute of Electrical Engineers of Japan, Technical Committee of Perception Information, Enhancement Cooperative Study Committee of Tactile Devices, First Seminar Data, pp. 1-6, Feb. 27, 2013

SUMMARY OF INVENTION

Technical Problem

When the position of an ultrasonic wave focal point is to be changed, it is necessary to change the phase. Ultrasonic waves are not audible to the human ear. However, when the phase is changed, a plosive sound, that is, a noise, is generated from an ultrasonic transducer. The generated noise may cause a problem depending on the environment where the ultrasonic wave focusing apparatus is used.

In light of the foregoing, it is an object of the present invention to reduce the noise generated by a phase change in an ultrasonic wave focusing apparatus that changes an ultrasonic wave focal point within a space by changing the phase of vibration of a plurality of ultrasonic transducers.

Solution to Problem

In order to achieve the above-described object, according to a first aspect of the present invention, there is provided an ultrasonic wave focusing apparatus including a transducer array and a control device. The transducer array includes a plurality of ultrasonic transducers. Position coordinates within a space are inputted to the control device, and the control device causes the ultrasonic transducers to generate ultrasonic waves having phases based on the position coordinates in such a manner that the ultrasonic waves of the ultrasonic transducers form a focal point at the position coordinates. When the inputted position coordinates within the space are changed, the control device calculates a target value for each target phase necessary for the ultrasonic waves outputted from the ultrasonic transducers to form a focal point at the changed position coordinates. As for an ultrasonic transducer whose current value for a current phase of an outputted ultrasonic wave is different from the target value, the control device changes a phase of the outputted ultrasonic wave to its target phase in multiple steps or continuously.

A plosive sound is generated from an ultrasonic transducer when a phase change occurs suddenly (i.e., discontinuously). Meanwhile, the present invention changes the phase in each of multiple steps. Therefore, the time interval between the rise and fall of a drive signal is unlikely to become excessively short. Consequently, the noise generated upon a phase change can be reduced.

DESCRIPTION OF EMBODIMENTS

First Embodiment

Figure 1:
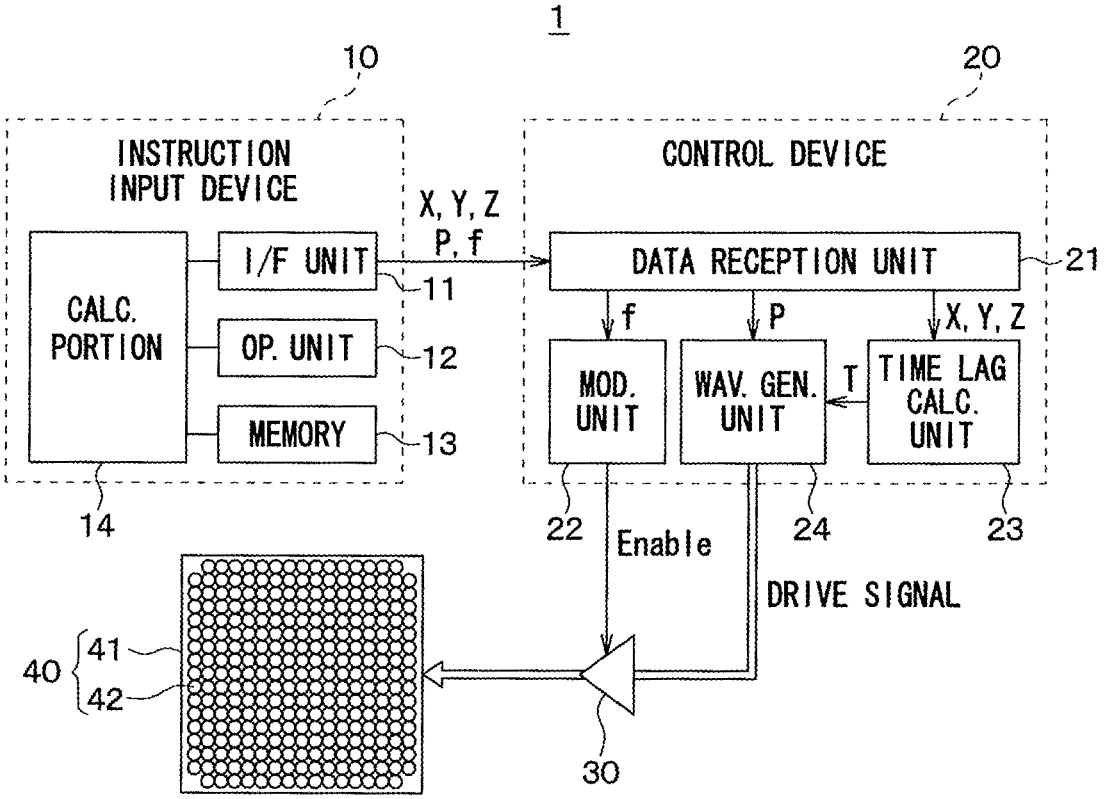
FIG. 1 is a diagram illustrating an overall configuration of an ultrasonic wave focusing apparatus 1 according to a first embodiment of the present invention.

A first embodiment of the present invention will now be described. As illustrated in FIG. 1, an ultrasonic wave focusing apparatus 1 according to the first embodiment includes an instruction input device 10, a control device 20, an amplifier 30, and a transducer array 40.

In accordance, for example, with a user operation, the instruction input device 10 inputs to the control device 20 the three-dimensional position coordinates X, Y, Z of an ultrasonic wave focal point, the sound pressure P of an ultrasonic wave, and the modulation frequency f of the ultrasonic wave. The instruction input device 10 may be implemented, for example, by a personal computer, a workstation, or a microcontroller.

The instruction input device 10 includes an interface unit 11, an operating unit 12, a memory 13, and a calculation portion 14. The interface unit 11 is an interface circuit through which a signal is inputted from the calculation portion 14 to the control device 20. The interface unit 11 may be implemented, for example, by a well-known USB interface. The operating unit 12 is a device that accepts a user operation, and may be implemented, for example, by a keyboard, a mouse, or a joystick. The memory 13 stores, for example, programs executable by the calculation portion 14. Further, the calculation portion 14 uses the memory 13 as a workspace.

The calculation portion 14 inputs the three-dimensional position coordinates X, Y, Z of an ultrasonic wave focal point, the sound pressure P of an ultrasonic wave, and the modulation frequency f of the ultrasonic wave to the control device 20 through the interface unit 11 by executing various programs to perform later-described processes.

Based on the three-dimensional position coordinates X, Y, Z, the sound pressure P, and the modulation frequency f, which are inputted from the instruction input device 10, the control device 20 inputs a plurality of drive signals and one Enable signal to the amplifier 30. As illustrated in FIG. 1, the control device 20 includes a data reception unit 21, a modulation unit 22, a time lag calculation unit 23, and a waveform generation unit 24.

The control device 20 may be implemented as a single FPGA board that implements, as hardware, all the functions of the data reception unit 21, modulation unit 22, time lag calculation unit 23, and waveform generation unit 24. The ACM-202-55C8 manufactured by HuMANDATA LTD. may be used as the FPGA board. Alternatively, each of the data reception unit 21, the modulation unit 22, the time lag calculation unit 23, and the waveform generation unit 24 may be implemented independently by a single microcomputer. The functions and operations of the data reception unit 21, modulation unit 22, time lag calculation unit 23, and waveform generation unit 24 will be described later.

The amplifier 30 amplifies a plurality of drive signals inputted from the control device 20, and subjects the amplified signals to AM modulation based on the Enable signal inputted from the control device 20. The amplifier 30 then inputs the amplified and AM-modulated drive signals to the transducer array 40. For example, the L293DD, which is a driver IC manufactured by STMicroelectronics, may be used as the amplifier 30.

The transducer array 40 includes a square-shaped circuit board 41 and a plurality of ultrasonic transducers 42, which are mounted on one surface of the circuit board 41. The number of ultrasonic transducers 42 is the same as the number of drive signals that are inputted from the amplifier 30 to the transducer array 40. In the present embodiment, the ultrasonic transducers 42 on the circuit board 41 are arrayed in a square grid point pattern that is formed of 17×17 points without four corner points, that is, formed of 285 points (=17×17−4).

In the present embodiment, 285 pieces of the T4010B4, which is manufactured by Nippon Ceramic Co, Ltd. for use as a parametric speaker, are used as the ultrasonic transducers 42. The T4010B4 has a resonance frequency of 40 kHz, a diameter of 1 cm in a plane parallel to the circuit board 41, and a sound pressure of 117 dB SPL at a distance of 30 cm. The drive signals from the amplifier 30 are inputted to the ultrasonic transducers 42 with polarities aligned on a one-to-one basis.

Figure 2:
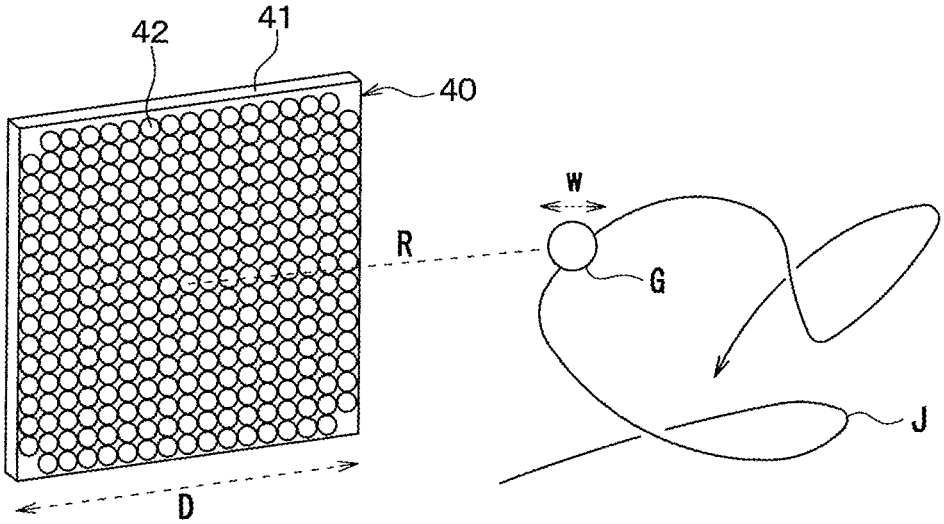
FIG. 2 is a diagram illustrating a trajectory J of a focal point G of an ultrasonic wave.

As the phases of ultrasonic vibrations outputted from the ultrasonic transducers 42 are individually set, the ultrasonic waves outputted from all the ultrasonic transducers 42 on the circuit board 41 form a single focal point G in a three-dimensional space as illustrated in FIG. 2. The relationship between the diameter w of the focal point G, the length D of each side of the transducer array 40 (the length of each side of the above-mentioned square), the wavelength λ of an ultrasonic wave outputted from each ultrasonic transducer 42, and the focal distance R is expressed by the equation $w=2\lambda R/D$. That is to say, the focal distance R is determined by the phase setting, and the diameter w of the focal point is determined by the focal distance R. In the present embodiment, w=20 mm when, for example, R=20 cm, λ=8.5 mm, and D=17 cm.

Operations performed by the ultrasonic wave focusing apparatus 1 having the above-described configuration will now be described. The calculation portion 14 of the instruction input device 10 determines the trajectory J (hourly position) of the focal point G of the ultrasonic waves within a three-dimensional space indicated in FIG. 2 in accordance with a user input from the operating unit 12 or with trajectory data prerecorded in the memory 13.

The focal point G of the ultrasonic waves is a position where the ultrasonic waves outputted from all the ultrasonic transducers 42 of the transducer array 40 are focused. The three-dimensional position coordinates X, Y, Z indicative of the position of the trajectory J are relative position coordinates with respect to the transducer array 40 within a coordinate system affixed to the transducer array 40.

The calculation portion 14 also determines the sound pressure P of an ultrasonic wave to be outputted from each ultrasonic transducer 42 and the modulation frequency f for AM modulation of an ultrasonic wave in accordance with a user input from the operating unit 12 or with data prerecorded in the memory 13. The sound pressure P and the modulation frequency f may remain constant regardless of time or vary with time.

Then, in accordance with the determined trajectory J, sound pressure P, and modulation frequency f, the calculation portion 14 periodically inputs the current three-dimensional position coordinates X, Y, Z on the trajectory J, the current sound pressure P, and the current modulation frequency f to the control device 20 at one-frame intervals (at intervals variable from 1 ms to 100 ms in increments of 1 ms as specified by a program in the present embodiment). These data are inputted to the control device 20 through the interface unit 11.

In the control device 20, the data reception unit 21 receives, at one-frame intervals, the three-dimensional position coordinates X, Y, Z, the sound pressure P, and the modulation frequency f, which are inputted from the interface unit 11 of the instruction input device 10 to the control device 20. The data reception unit 21 inputs the received modulation frequency f to the modulation unit 22 at one-frame intervals, inputs the received three-dimensional position coordinates X, Y, Z to the time lag calculation unit 23 at one-frame intervals, and inputs the received sound pressure P to the waveform generation unit 24 at one-frame intervals. The data reception unit 21 expresses each of the three-dimensional position coordinates X, Y, Z by using a digital value that is variable in increments of 0.25 mm, which is equivalent to approximately 1/32 of the wavelength of an ultrasonic wave. In the control device 20, therefore, the values of the three-dimensional position coordinates X, Y, Z are variable in increments of 0.25 mm.

In accordance with the modulation frequency f inputted from the data reception unit 21, the modulation unit 22 inputs the Enable signal to the amplifier 30. The Enable signal is used so that an ultrasonic wave is AM-modulated by the modulation frequency f. The Enable signal used in the present embodiment is a rectangular wave having a frequency equal to the modulation frequency f and an on/off duty cycle of 50%. The modulation frequency f to be inputted to the modulation unit 22 is selectable from 0 Hz to 1023 Hz in increments of 1 Hz. A band from 1 Hz to 1023 Hz is equivalent to a range within which human tactile perception can be effectively stimulated.

Based on the three-dimensional position coordinates X, Y, Z inputted from the data reception unit 21 at one-frame intervals, the time lag calculation unit 23 calculates the vibration time lag T between the 285 ultrasonic transducers 42 in such a manner that the ultrasonic waves form a single focal point at a position indicated by the three-dimensional position coordinates X, Y, Z. For example, the time lag T to be calculated is a time advance of the ultrasonic wave outputted from each ultrasonic transducer 42 from the ultrasonic wave outputted from a preselected reference ultrasonic transducer 42 (e.g., the ultrasonic transducer 42 positioned at the center). The time lag T is proportional to the amount of phase advance of ultrasonic vibration of each ultrasonic transducer 42 from ultrasonic vibration of the reference ultrasonic transducer 42. The time lag calculation unit 23 inputs the calculated time lag T to the waveform generation unit 24 at one-frame intervals.

Figure 3:
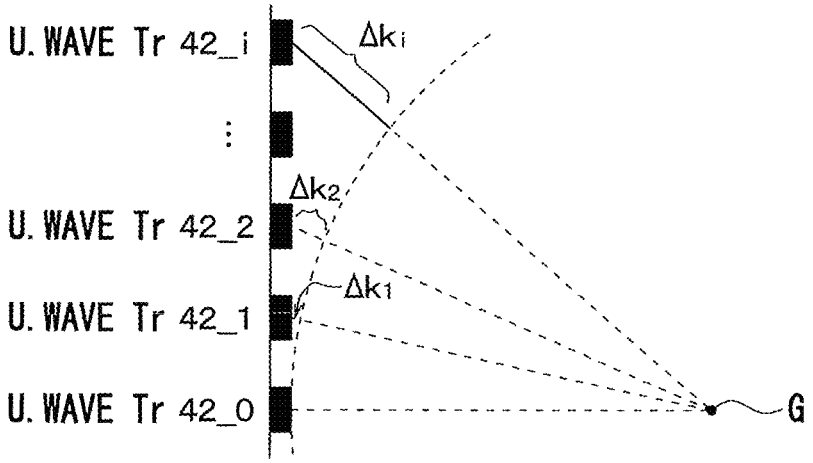
FIG. 3 is a diagram illustrating the positional relationship between the focal point G and a plurality of ultrasonic transducers.
Figure 4:
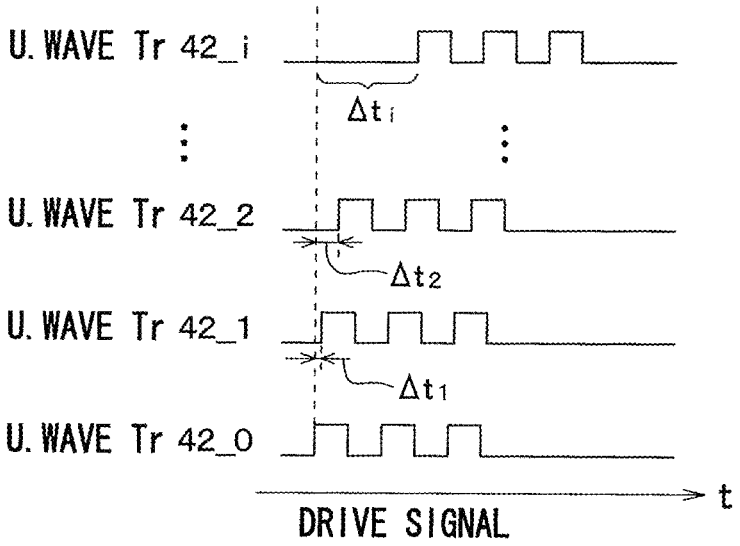
FIG. 4 is a diagram illustrating the phase shifts of drive signals to the ultrasonic transducers.

The method of calculating the time lag T will now be described with reference to FIGS. 3 and 4. As illustrated in FIG. 3, the reference ultrasonic transducer 42_0 differs from the other ultrasonic transducers 42_1, 42_2, . . . **42_*i* in the straight-line distance to the focal point G. For example, the straight-line distance from the ultrasonic transducer 42_*i* to the focal point G is longer by Aki than the straight-line distance from the reference ultrasonic transducer 42_0** to the focal point G.

In the above instance, the time lag Δti between the reference ultrasonic transducer 42_0 and the ultrasonic transducer **42_*i* is obtained from the equation Δti=Δki/c0. The symbol c0 represents the speed of sound in air. As indicated in FIG. 4, the equation signifies that the longer the distance from an ultrasonic transducer 42** to the focal point G, the earlier the generation of sound (the more advanced the time is).

In the present embodiment, the time lag calculation unit 23 uses the above principle to calculate the straight-line distance from each ultrasonic transducer 42 to the focal point G. The time lag calculation unit 23 then calculates the amount of increase Δki in the straight-line distance between each ultrasonic transducer 42 and the focal point G from the straight-line distance between the reference ultrasonic transducer 42_0 and the focal point G (however, i=0, 1, 2, . . . , 284). Each of the calculated amounts of increase Δki is then applied to the above equation Δti=Aki/c0, and each of the obtained values Δti is regarded as the time lag T of each ultrasonic transducer 42. The value of the speed of sound c0 in air may be a predetermined fixed value or may be determined as appropriate from temperature and humidity measurements.

Based on the sound pressure P inputted at one-frame intervals from the data reception unit 21 and on the time lag T of each ultrasonic transducer 42, which is inputted at one-frame intervals from the time lag calculation unit 23, the waveform generation unit 24 generates a drive signal for each ultrasonic transducer 42.

The drive signal is basically a rectangular wave having a frequency of 40 kHz. However, the duty cycle of the drive signal is adjusted by subjecting it to PWM (pulse-width modulation) in such a manner as to obtain the sound pressure P inputted from the data reception unit 21. Further, the phase of the drive signal changes in accordance with changes in the time lag T inputted from the time lag calculation unit 23.

Figure 5:
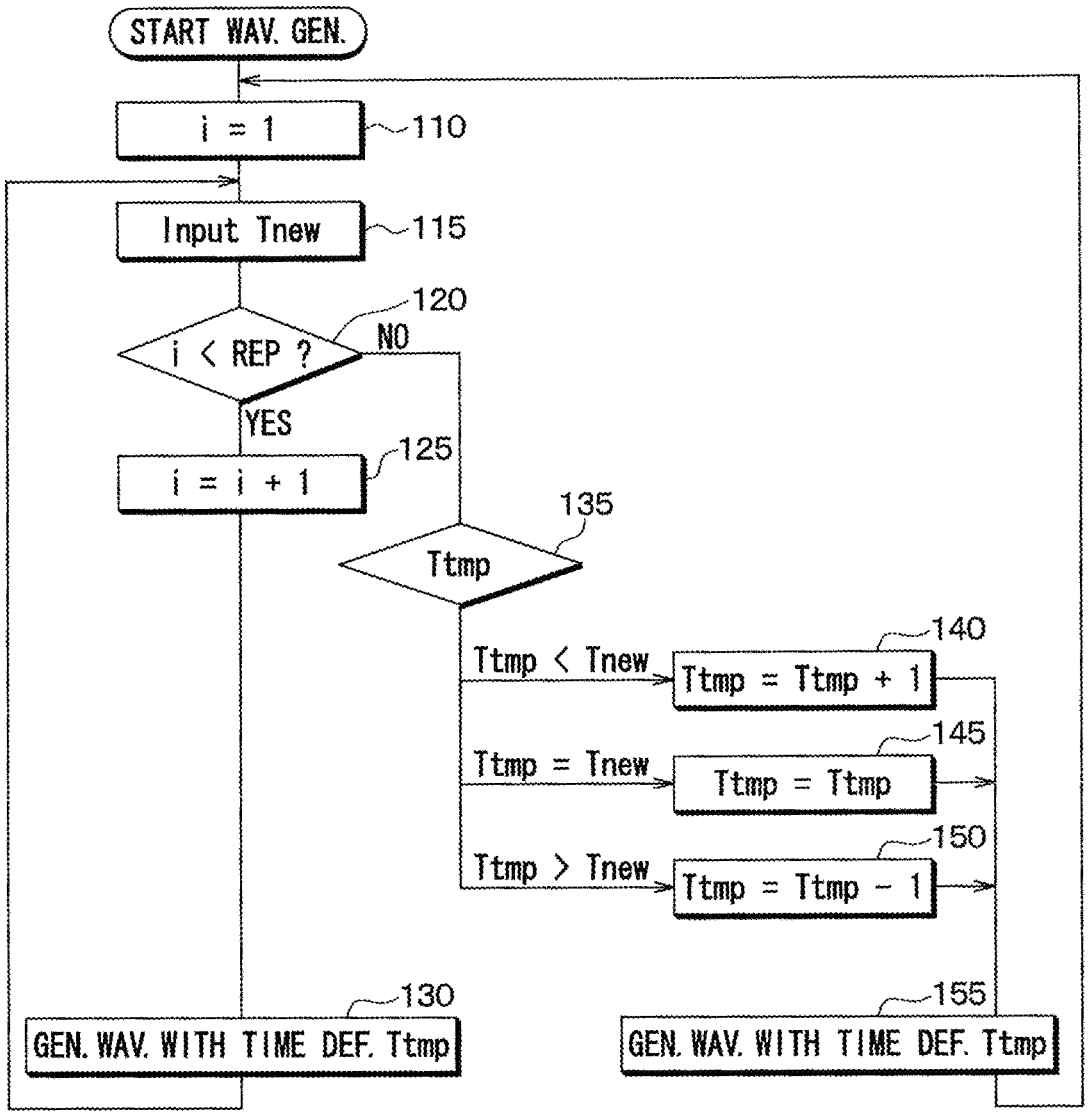
FIG. 5 is a flowchart illustrating a waveform generation process according to the first embodiment.

FIG. 5 is a flowchart illustrating a waveform generation process performed by the waveform generation unit 24. The waveform generation unit 24 performs one waveform generation process for each ultrasonic transducer 42. Consequently, a total of 285 waveform generation processes are simultaneously performed.

First of all, variables used in FIG. 5 will be described. The variable i is an integer that varies at intervals (of 25 μs), which correspond to a frequency of 40 kHz. The variable Tnew is an integer indicative of the latest value of the time lag T inputted from the time lag calculation unit 23. The variable Ttmp is an integer that has an initial value of zero and indicates the time lag given by an actually generated drive signal (the time advance from the reference ultrasonic transducer). In the present embodiment, the time lag Tnew and the time lag Ttmp are variable in increments of 25/16 μs, which is the length of time obtained by dividing the cycle of ultrasonic vibration of an ultrasonic transducer 42 by 16. As explained earlier, these variables are proportional to the amount of phase advance. Therefore, each of the values of Ttmp and Tnew is an integer between 0 and 15. However, the time lag Ttmp and the time lag Tnew are amounts proportional to the phase difference, and the phase difference within one cycle is equivalent to a phase difference of zero. Therefore, it can be said that the time lag between the maximum and minimum values of Ttmp and Tnew is substantially equal to one increment. The threshold value REP is an integer indicative of phase change intervals at which Ttmp is updated. If, for example, the threshold value REP is 2, Ttmp is updated at two-cycle intervals.

The variable i, the time lag Tnew, and the time lag Ttmp are local variables within one waveform generation process. These local variables are not related to the variable i, the time lag Tnew, and the time lag Ttmp in the other waveform generation processes. The threshold value REP is a global variable that is commonly referenced by all the waveform generation processes. That is to say, the threshold value REP remains the same in all the waveform generation processes.

The time lag Tnew and the time lag Ttmp may be variable in increments of 25/32 μs, which is the length of time obtained by dividing the cycle of ultrasonic vibration of an ultrasonic transducer 42 by 32.

In step 110 of the waveform generation process for each ultrasonic transducer 42, the waveform generation unit 24 first substitutes 1 into the variable i. Next, in step 115, the waveform generation unit 24 acquires the latest value Tnew of the time lag T of a target ultrasonic transducer 42, which is inputted from the time lag calculation unit 23. The time lag Tnew is updated at one-frame intervals (1 ms or longer) as mentioned earlier. As one cycle is equal to 25 μs, the time lag Tnew is updated at least 40-cycle intervals. Therefore, the value of Tnew remains the same for at least 40 cycles.

Next, in step 120, the waveform generation unit 24 determines whether the variable i is smaller than the threshold value REP. If the variable i is smaller than the threshold value REP, the waveform generation unit 24 proceeds to step 125. If the variable i is equal to the threshold value REP, the waveform generation unit 24 proceeds to step 135. The determination process in step 120 is a process of determining whether or not the time lag Ttmp can be changed during the current cycle.

In step 125, the value of the variable i is increased by one. Next, in step 130, one cycle (25 μs) of a drive signal having the current time lag Ttmp is generated and inputted to the amplifier 30. The drive signal having the time lag Ttmp is, more specifically, a drive signal that is advanced by the time lag Ttmp from a reference timing, which is fixed for all ultrasonic transducers 42.

It is assumed that the duty cycle of the drive signal generated in the above instance corresponds to the inputted latest sound pressure P. The closer to 50% the duty cycle of the drive signal is, the higher the sound pressure outputted from a target ultrasonic transducer 42. Here, the sound pressure P is an integer. In the present embodiment, the sound pressure P is variable in increments of 25/1248 μs, which is the length of time obtained by dividing the cycle of ultrasonic vibration of an ultrasonic transducer 42 by 1248, and is proportional to the duty cycle. In this instance, the value 623 of the sound pressure P corresponds to a duty cycle of 50%. Upon completion of step 130, processing returns to step 115.

In step 135, the current time lag Ttmp is compared with the time lag Tnew. If Ttmp<Tnew, processing proceeds to step 140. In step 140, the value of Ttmp is increased by one to determine whether Ttmp=Tnew. If Ttmp=Tnew, processing proceeds to step 145. In step 145, the current value of Ttmp is maintained. If, by contrast, Ttmp>Tnew, processing proceeds to step 150. In step 150, the value of Ttmp is decreased by one.

Specifically, in steps 140 and 150, the current time lag Ttmp is changed by one step (25/16 μs) so as to become closer to the time lag Tnew. In step 145, the time lag Ttmp is maintained as is because it is equal to the time lag Tnew.

Upon completion of step 140, 145, or 150, processing proceeds to step 155. In step 155, in the same manner as in step 130, one cycle (25 μs) of a drive signal having the current time lag Ttmp is generated and inputted to the amplifier 30. In this instance, it is assumed that the duty cycle of the drive signal corresponds to the inputted latest sound pressure P. Upon completion of step 155, processing returns to step 110. In step 110, the variable i reverts to 1.

The drive signal, which is generated as described above by the waveform generation unit 24 for each ultrasonic transducer 42 at one-cycle intervals, is inputted to the amplifier 30. The amplifier 30 amplifies each drive signal inputted from the waveform generation unit 24, and subjects each amplified drive signal to AM modulation by multiplying each amplified drive signal by the Enable signal inputted from the modulation unit 22. The amplifier 30 then inputs each amplified and AM-modulated drive signal to its respective ultrasonic transducer 42 in the transducer array 40.

As each drive signal inputted from the waveform generation unit 24 to the amplifier 30 is AM-modulated by the Enable signal and inputted to a respective ultrasonic transducer 42 as described above, the ultrasonic vibration outputted from the transducer array 40 is able to stimulate human tactile perception.

Further, as each ultrasonic transducer 42 outputs an ultrasonic wave having a phase that is advanced by an amount equivalent to the time lag Tnew of each ultrasonic transducer 42, the ultrasonic waves outputted from the transducer array 40 focus to form the focal point G. Moreover, the position of the focal point G varies along the trajectory J at one-frame intervals. Consequently, tactile stimulation along the trajectory J can be given to the human hand.

The above-mentioned application in which human tactile stimulation is given at the focal point G moving on the trajectory J is based on a technology that utilizes a phenomenon known as acoustic radiation pressure. Another application can be implemented so as to move a sound source along the trajectory J by utilizing the phenomenon of self-demodulation, which is the basic principle of a parametric speaker. Still another application can be implemented so as to invoke the floating movement, for example, of a particle, a water droplet, or an insect along the trajectory J by utilizing the phenomenon of acoustic floating, which retains an object smaller than a wavelength in air. Further, various other applications can be implemented by utilizing, for example, a strong ultrasonic wave, a noncontact force, or an airflow that is generated at the focal point G of ultrasonic waves.

The relationship between the drive signals outputted from the waveform generation unit 24 and the ultrasonic waves outputted from the ultrasonic transducers 42 will now be described.

While Ttmp=Tnew in all the waveform generation processes performed by the waveform generation unit 24, the ultrasonic vibrations outputted from the ultrasonic transducers 42 focus to form the focal point G at the latest position coordinates X, Y, Z inputted from the instruction input device 10.

Let us assume that the calculation portion 14 subsequently inputs new position coordinates (X, Y, Z)=(X1, Y1, Z1), which are different from the previous position coordinates (X, Y, Z)=(X0, Y0, Z0), to the control device 20 through the interface unit 11. The data reception unit 21 then inputs the position coordinates X1, Y1, Z1 to the time lag calculation unit 23. The time lag calculation unit 23 then calculates the time lag T=Tnew of each ultrasonic transducer 42 and inputs the calculated time lag to the waveform generation unit 24 so that the ultrasonic waves focus to form the focal point G at the position coordinates X1, Y1, Z1.

Here, it is assumed that the variable REP is set to 1. In such an instance, the waveform generation unit 24 is such that the query in step 120 is always answered "NO" during each waveform generation process. Therefore, while Ttmp is different from Tnew, the waveform generation unit 24 changes Ttmp by one increment (1/16 of one cycle) in order to make Ttmp closer to Tnew in step 140 or 150 during each cycle. Then, in step 155, the waveform generation unit 24 generates one cycle of a drive signal based on the changed Ttmp, and inputs the generated drive signal to the amplifier 30. That is to say, the waveform generation unit 24 changes the phase of vibration outputted from an ultrasonic transducer 42 (the phase corresponding to the time lag Ttmp) to a target phase (the phase corresponding to the time lag Tnew) gradually in multiple steps but not totally at one time.

More specifically, let us assume that the new position coordinates X1, Y1, Z1 are inputted to the time lag calculation unit 23 as described above at time t1 in FIG. 6. Let us then assume that, based on the position coordinates X1, Y1, Z1, the time lag calculation unit 23 inputs the new time lag Tnew for a particular ultrasonic transducer 42, which is advanced from the current time lag Ttmp by seven increments (i.e., 25/16×7 μs), to the waveform generation unit 24. In such an instance, the relationship between the target time lag Tnew and the current time lag Ttmp at time t1 is expressed by the following equation.

$$Tnew=Ttmp+25/16\times7[\mu s]$$

Figure 6:
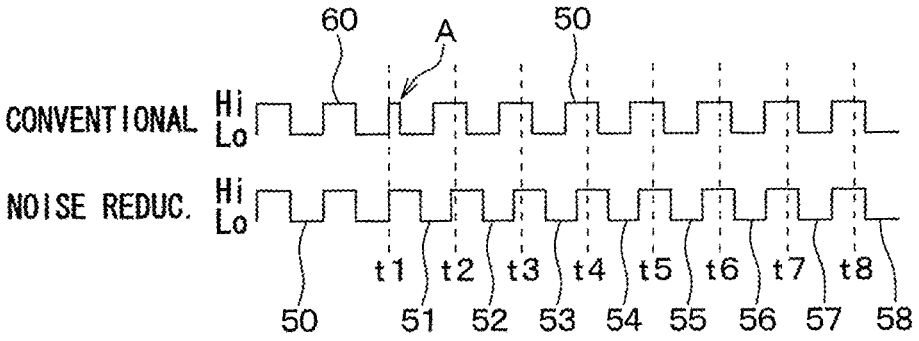
FIG. 6 is a diagram illustrating temporal changes in the phases of drive signals used in a prior art and in the present embodiment.

In the above instance, at time t1 in FIG. 6 and during the waveform generation process performed for the particular ultrasonic transducer 42, the waveform generation unit 24 determines in step 135 that Ttmp<Tnew, then proceeds to step 140, and increases the value of Ttmp by one increment. As a result, Tnew=Ttmp+25/16×6 [μs]. This reduces the difference between the target time lag Tnew and the current time lag Ttmp. Then, in step 155, one cycle of a drive signal 51 based on the increased Ttmp is generated and inputted to the amplifier 30. The drive signal 51 is outputted during one cycle between time t1 and time t2 and phase-advanced from a drive signal 50 outputted before time t1 by one step (i.e., 25/16 μs).

Subsequently, also at time t2, the waveform generation unit 24 proceeds from step 135 to step 140 and increases the value of Ttmp by one increment. As a result, Tnew=Ttmp+25/16×5 [μs]. This further reduces the difference between the target time lag Tnew and the current time lag Ttmp. Then, in step 155, the waveform generation unit 24 inputs to the amplifier 30 one cycle (between time t2 and time t3) of a drive signal 52 that is phase-advanced from the drive signal 51 by one step in accordance with the increased Ttmp.

At time t3, time t4, time t5, time t6, and time t7, which come at one-cycle intervals after time t2, the waveform generation unit 24 also proceeds from step 135 to step 140 and increases the value of Ttmp by one step. Then, in step 155, the waveform generation unit 24 inputs to the amplifier 30 one cycle of drive signals 53, 54, 55, 56, 57 that are phase-advanced from the preceding drive signal by one increment in accordance with the increased Ttmp.

At time t7, Tnew=Ttmp because Ttmp is increased in step 140. Therefore, at time t8, which is one cycle after time t7, the waveform generation unit 24 determines in step 135 that Ttmp=Tnew, then proceeds to step 145, and maintains the value of the current time lag Ttmp. In step 155, the waveform generation unit 24 inputs to the amplifier 30 one cycle of a drive signal 58 having the same phase as in a period before time t8. Subsequently, the time lag Ttmp of the particular ultrasonic transducer 42 remains unchanged unless the three-dimensional position coordinates X, Y, Z inputted from the instruction input device 10 change to change the time lag Tnew of the particular ultrasonic transducer 42.

Accordingly, in the above example, the time required for Ttmp to reach Tnew after a change in Tnew is 6×25=150 which is between time t1 and time t7. Further, the ultrasonic transducers 42 vary in the time required to reach the target phase Tnew. However, no practical problem is caused by a delayed time interval between the instant at which the target time lag Tnew is changed and the instant at which the current time lag Ttmp reaches the target time lag Tnew or caused by variations of the ultrasonic transducers 42 in the length of the delay in the time interval. The reason is that the maximum difference between the current time lag Ttmp and the target time lag Tnew is equivalent to 15 increments, and that changes of up to 40 increments terminate within one frame (1 ms minimum), and further that the startup time required for each ultrasonic transducer 42 is 1 ms.

After a change in the position coordinates X, Y, Z inputted from the instruction input device 10 to the control device 20, the ultrasonic waves outputted from the ultrasonic transducers 42 may or may not form a focal point depending on the situation before Ttmp of every ultrasonic transducer 42 reaches Tnew. However, the ultrasonic waves outputted from the ultrasonic transducers 42 focus to form the focal point G during the interval between the instant at which Ttmp of every ultrasonic transducer 42 reaches Tnew and the instant at which the position coordinates X, Y, Z inputted from the instruction input device 10 to the control device 20 are further changed.

As described above, when the inputted position coordinates X, Y, Z within a three-dimensional space are changed, the time lag calculation unit 23 performs calculations on ultrasonic waves outputted from a plurality of ultrasonic transducers 42 to determine the time lag Tnew (equivalent to an example of the target value) that corresponds a target phase required for the ultrasonic waves to form the focal point G at the changed position coordinates X1, Y1, Z1. The waveform generation unit 24 then examines the ultrasonic transducers 42 to locate a particular ultrasonic transducer 42 whose target time lag Tnew differs from the time lag Ttmp (corresponding to an example of the current value) corresponding to the current phase of an outputted ultrasonic wave, and changes the phase of an ultrasonic wave outputted from the particular ultrasonic transducer 42 to the target phase in multiple steps (steps 140 and 150).

The reason why the phase Ttmp of vibration outputted from an ultrasonic transducer 42 is changed to the target phase Tnew gradually in multiple steps and not totally at one time will now be described.

When the ultrasonic wave focal point G changes to change the phase of a drive signal to an ultrasonic transducer 42, the phase of an ultrasonic wave outputted from the ultrasonic transducer 42 also changes. The ultrasonic wave is not audible to the human ear. However, when the phase is changed, a plosive sound, that is, a noise, is generated from the ultrasonic transducer. The generated noise may cause a problem depending on the environment where the ultrasonic wave focusing apparatus is used. If, for example, the ultrasonic wave focusing apparatus is used in the vicinity of a human, it is preferable that the noise be suppressed.

It is conceivable that the noise may be reduced by two different methods. The first method is to decrease the distance moved by the position coordinates X, Y, Z of the ultrasonic wave focal point G, which are outputted from the instruction input device 10 to the control device 20.

This method decreases the distance moved by the focal point G per frame (a period equal to or longer than an ultrasonic transducer startup time of 1 ms). In the present embodiment, the time lag calculation unit 23 and the waveform generation unit 24 discretely handle the phase (T, Tnew, Ttmp). This decreases the number of ultrasonic transducers that change the phase when the distance moved is short. Therefore, the noise can be suppressed by decreasing the number of ultrasonic transducers that simultaneously emit a plosive sound. However, this method is not appropriate when the focal point G is to be quickly moved, that is, when the distance moved per frame by the focal point G is to be increased.

Consequently, the present embodiment uses the second method. When the second method is used, the phase of ultrasonic vibration outputted from an ultrasonic transducer 42 is changed to the target phase gradually in multiple steps and not totally at one time.

The above-mentioned plosive sound is generated when a phase change occurs suddenly (i.e., discontinuously). For example, the plosive sound is generated when a downward movement signal is inputted to a vibration plate in an ultrasonic transducer that is about to move upward.

If, for example, the position coordinates X, Y, Z inputted at time t1 from the instruction input device 10 change from X0, Y0, Z0 to X1, Y1, Z1 in a conventional manner, as indicated in the upper half of FIG. 6, and the phase of a drive signal 60 totally changes by seven increments in accordance with the change in the position coordinates X, Y Z, the time interval A between the rise and fall of the drive signal is excessively short. This results in the generation of a plosive sound.

Meanwhile, the drive signals 50-58 in the present embodiment, which are depicted in the lower half of FIG. 6, change the phase gradually in multiple steps one by one as explained earlier. This reduces the possibility of the time interval between the rise and fall of the drive signals becoming excessively short.

As described above, even when a significant change occurs in the position coordinates X, Y, Z inputted from the instruction input device 10 to the control device 20, the present embodiment suppresses the noise by minimizing the change in the phase of a drive signal inputted to an ultrasonic transducer 42. Further, suppressing the noise in the above manner suppresses a noise. Therefore, when the ultrasonic wave focusing apparatus 1 is used to acoustically float an object, the object is unlikely to fall.

In the example of FIG. 6, the variable REP is set to 1. However, if the variable REP is set to 2 or greater, the waveform generation unit 24 performs steps 125 and 130 a number of times smaller by one than the variable REP even when Ttmp is different from Tnew.

Accordingly, if, for example, the example of FIG. 6 is changed so that the variable REP is 3, the waveform generation unit 24 outputs a drive signal having the same phase Ttmp during two consecutive cycles in step 130 even when Ttmp is different from Tnew. Subsequently, after the determination result obtained in step 120 indicates that i=REP, the waveform generation unit 24 proceeds to step 135 and changes Ttmp in step 140 or 150. That is to say, when the example of FIG. 6 is changed so that the variable REP is N (N is two or greater), the waveform generation unit 24 changes Ttmp by one step at N-cycle intervals on and after time t1.

When Tnew is changed as described above by a change in the position coordinates X, Y, Z inputted from the instruction input device 10 to the control device 20, the phase of a drive signal can be changed at least by methods (a), (b), (c), and (d) below.

(a) A method of changing the phase totally at one time in a conventional way (without applying a noise reduction method according to the present embodiment)

(b) A method of changing the phase in multiple steps at one-cycle intervals (by setting REP to 1 in the present embodiment)

(c) A method of changing the phase in multiple steps at two-cycle intervals (by setting REP to 2 in the present embodiment)

(d) A method of changing the phase in multiple steps at three-cycle intervals (by setting REP to 3 in the present embodiment)

According to the experiences of the inventors of the present invention, the highest level of noise reduction is provided by method (c). Method (c) provides a higher level of noise reduction than method (b) probably because the drive signal is closer to continuity when method (c) is used. Method (d) generates a higher level of noise than method (c) probably because the phase change made at three-cycle intervals (at intervals of 75 microseconds) generates a 13 kHz sound, which is audible to the human ear.

Consequently, even when the phase is to be changed at multiple-cycle intervals, it is preferable that the intervals be outside the human audible range (a frequency of 20 Hz to 20 kHz or intervals of 50 ms to 50 μs). It is therefore preferable that the phase be changed at multiple-cycle intervals of not longer than 50 μs. In the present embodiment, the value of REP may be set to 4 or greater.

Figure 7:
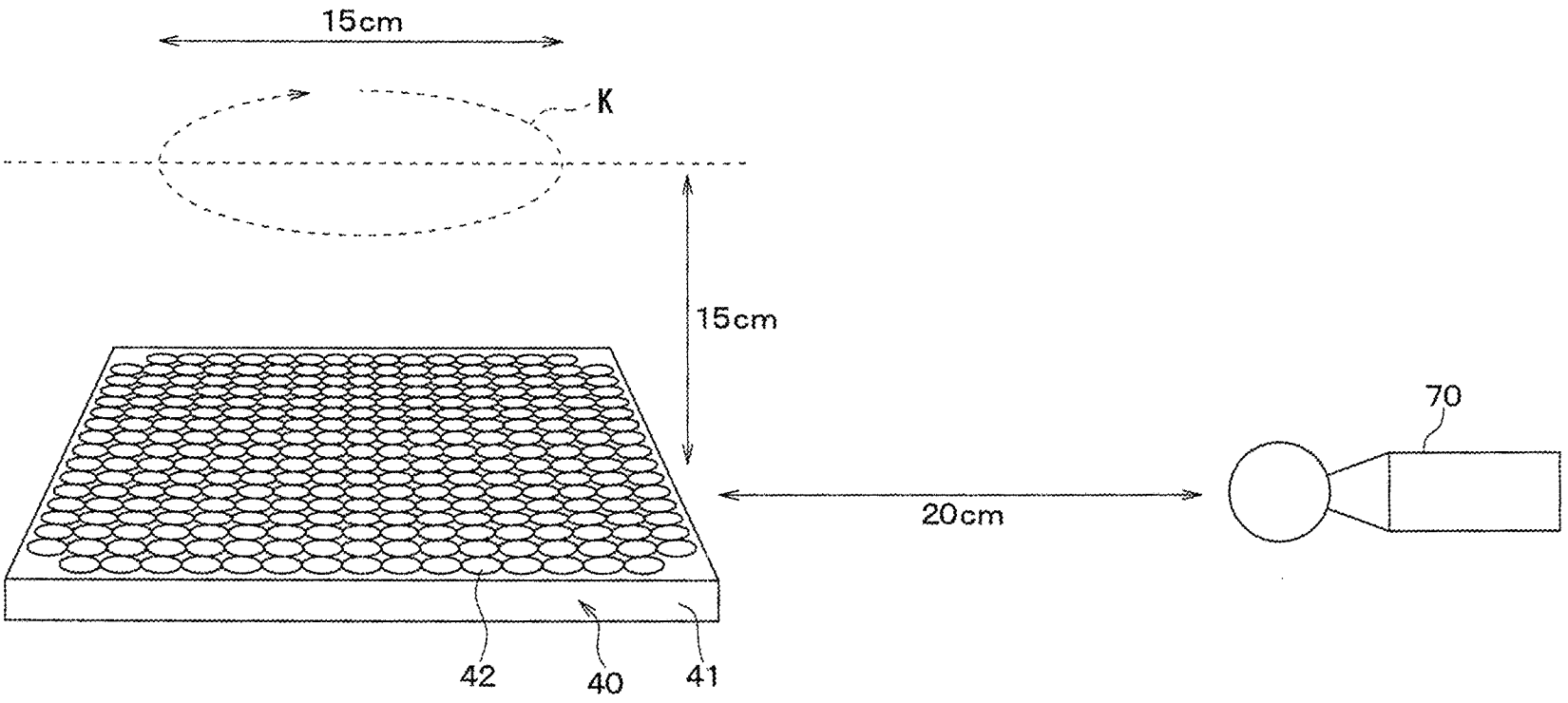
FIG. 7 is a diagram illustrating a configuration of an experiment environment.

The results of a noise measurement experiment conducted with various combinations of the length of time of a frame (the reciprocal of a frame rate) and phase change intervals REP will now be described. In the experiment, as illustrated in FIG. 7, the circuit board 41 on which the transducer array 40 is mounted is horizontally disposed. The calculation portion 14 of the instruction input device 10 successively outputs the three-dimensional position coordinates X, Y, Z of an ultrasonic wave focal point in such a manner that the focal point G continuously moves along a 15-cm-diameter circular trajectory K at a constant velocity of 2 revolutions per second at a height of 15 cm from the transducer array 40.

Further, the experiment assumes that the time lag Tnew and the time lag Ttmp are variable in increments of 25/32 μs, which is obtained by dividing the ultrasonic vibration cycle of an ultrasonic transducer 42 by 32. Therefore, Tnew and Ttmp vary in steps of 25/32 μs. Further, Ttmp and Tnew take an integer value between 0 and 31.

Seven different lengths of time of the frame, namely, 1 ms, 1.5 ms 3 ms, 10 ms, 15 ms, 30 ms, and 100 ms, are used in the experiment. Nine different values, namely, 0, 1, 2, . . . 7, and 8, are used as the values of the phase change intervals REP.

Figure 8:
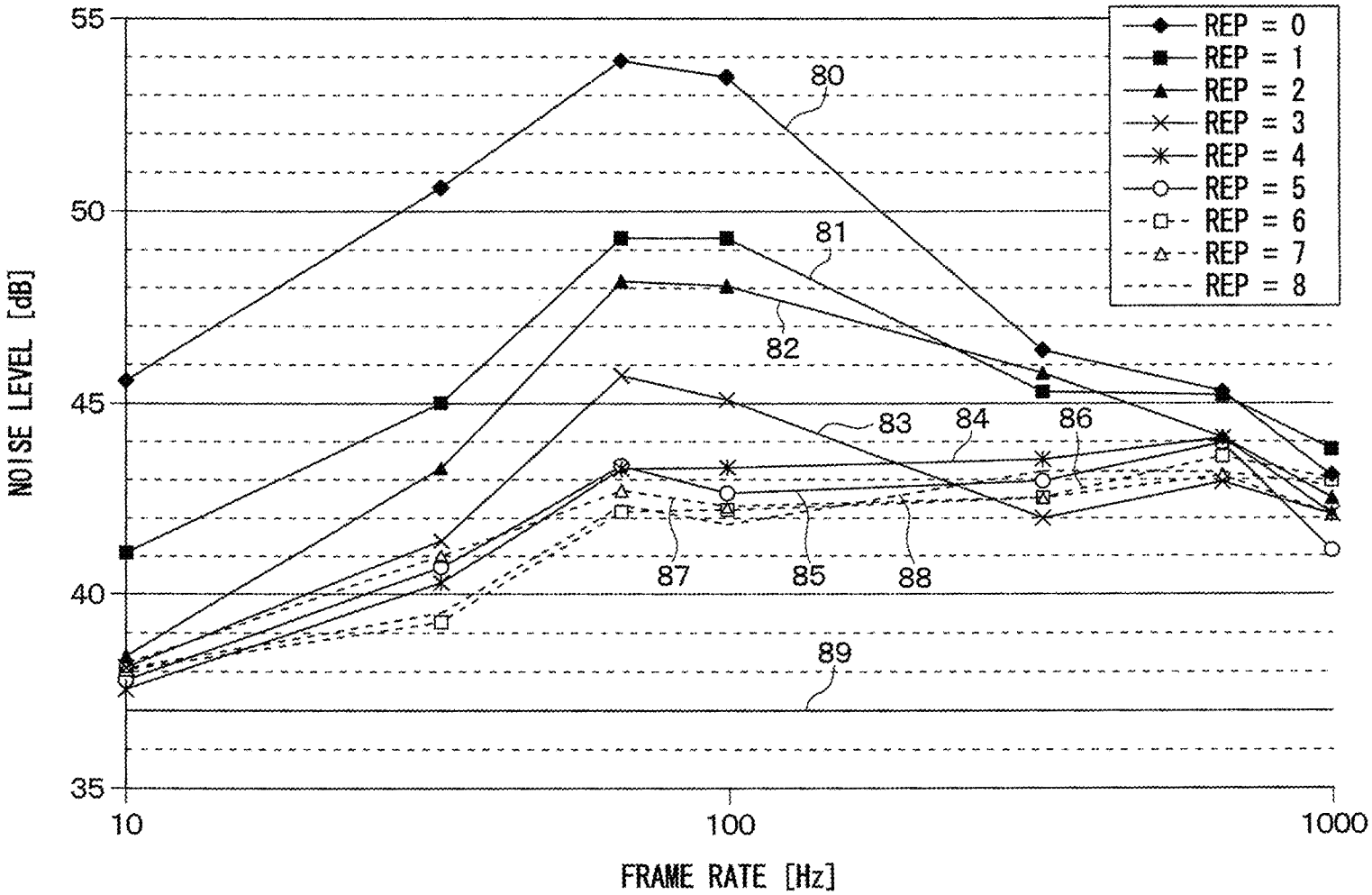
FIG. 8 is a graph illustrating the results of experiments.
Figure 9A:
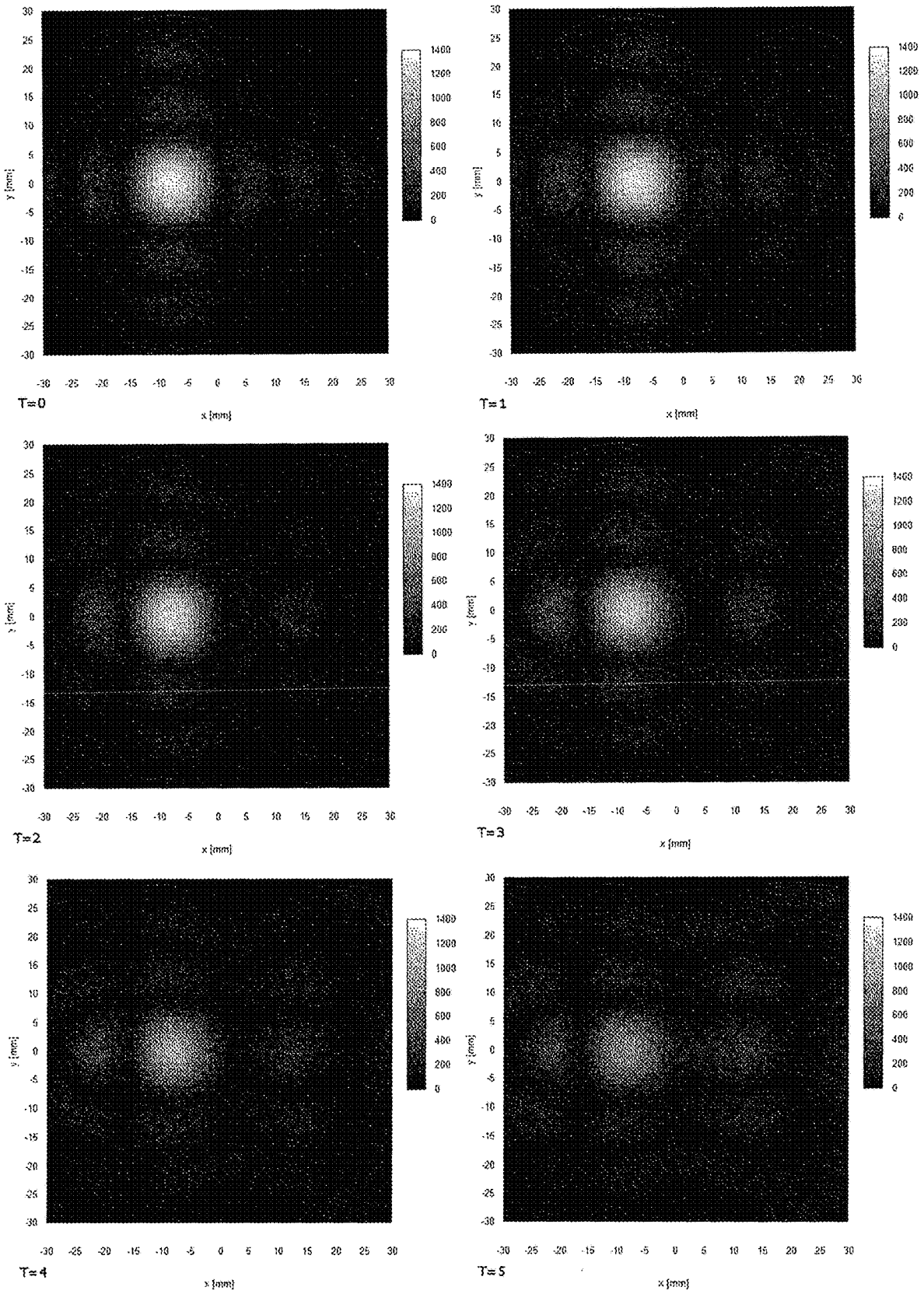
FIG. 9A is a diagram illustrating the movements of the focal point.
Figure 9B:
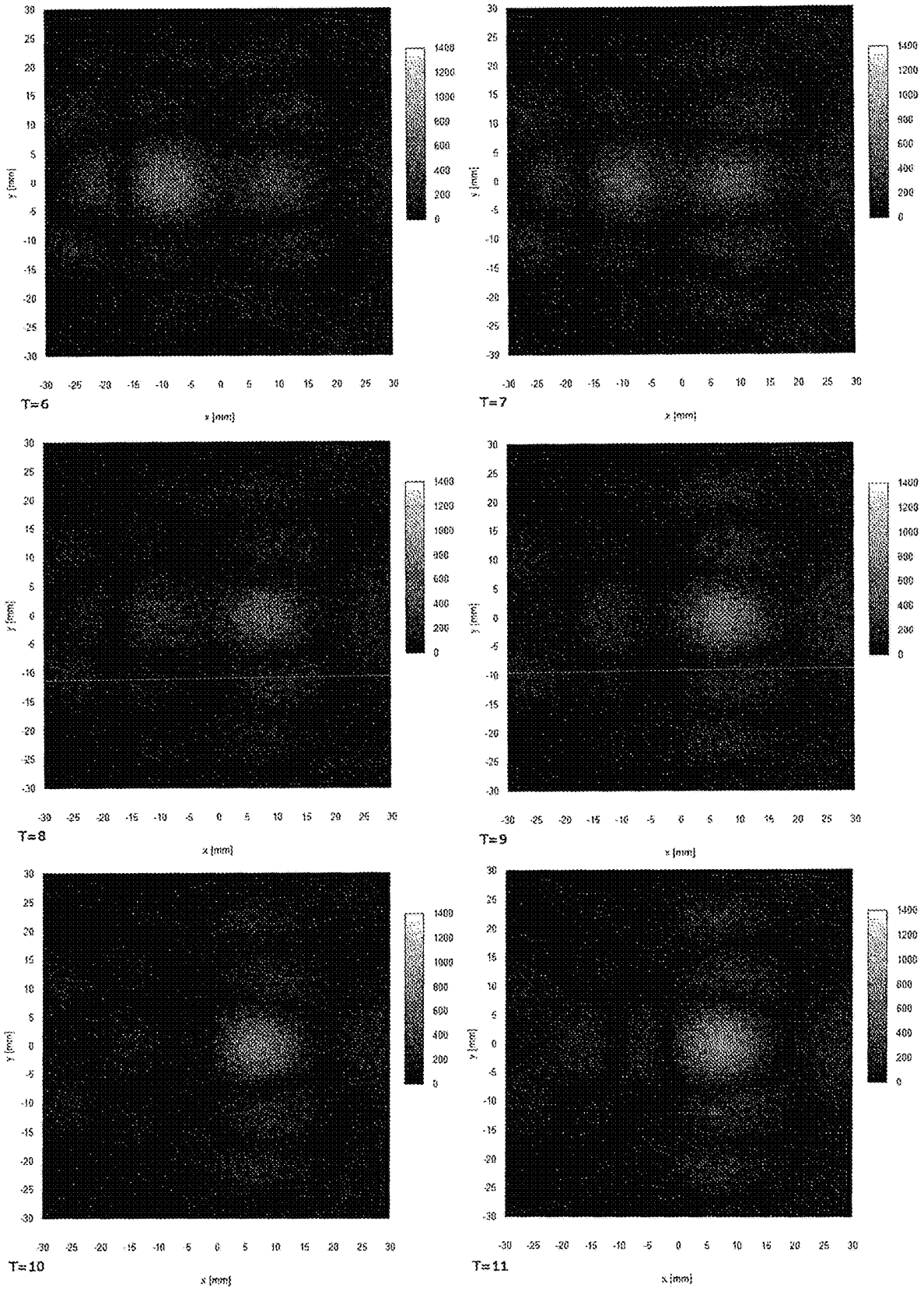
FIG. 9B is a diagram illustrating the movements of the focal point.
Figure 9C:
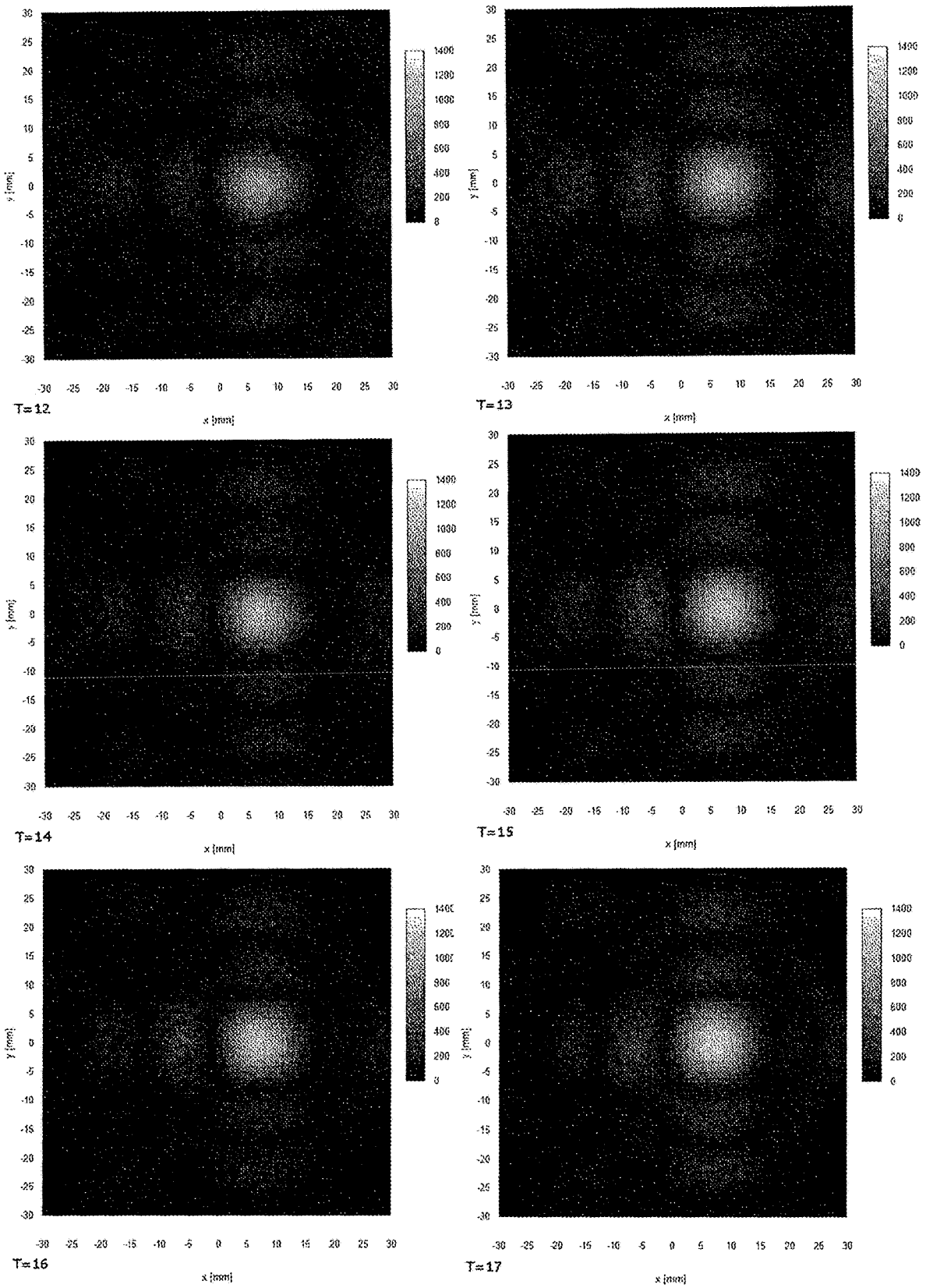
FIG. 9C is a diagram illustrating the movements of the focal point.
Figure 9D:
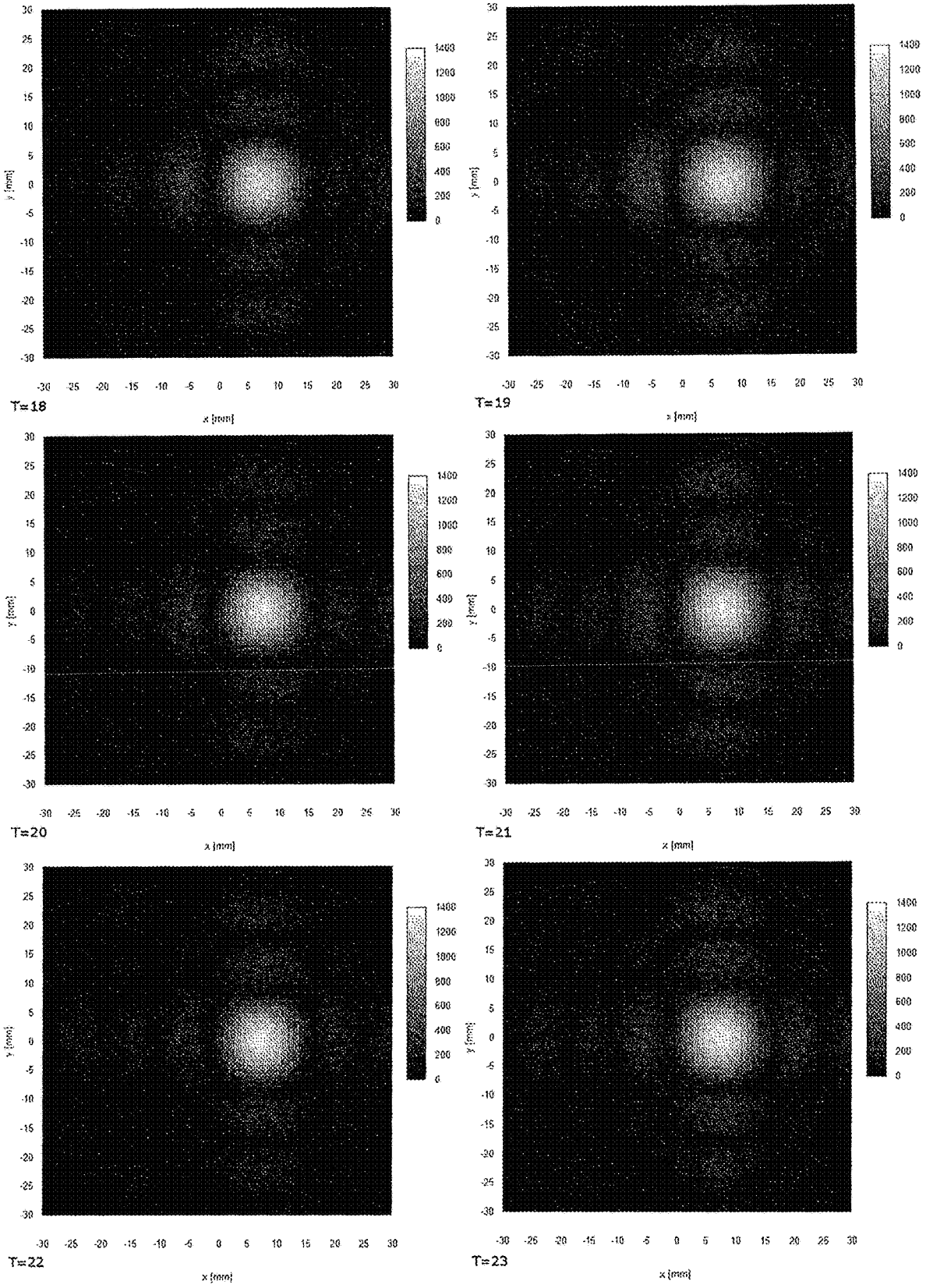
FIG. 9D is a diagram illustrating the movements of the focal point.
Figure 9E:
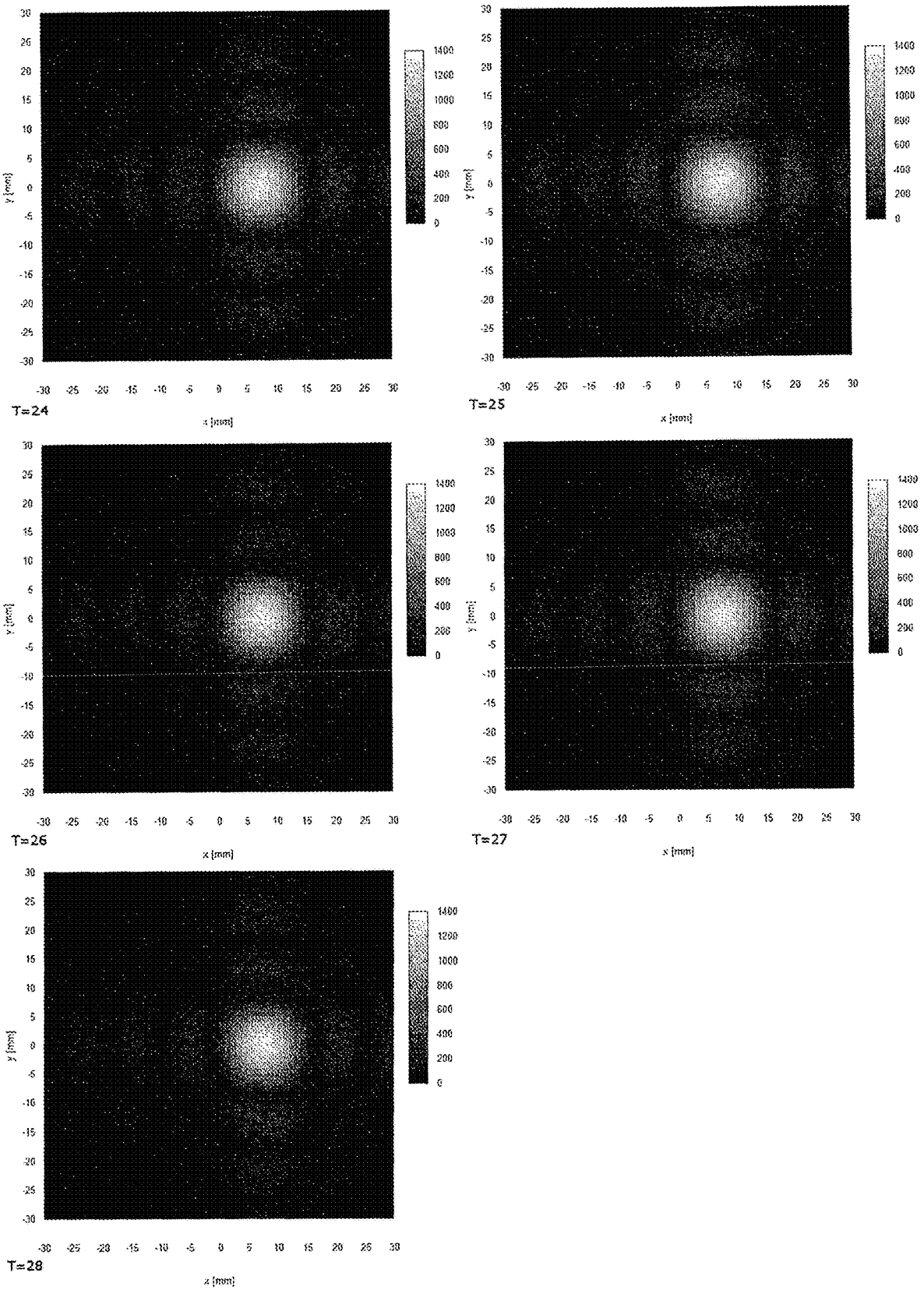
FIG. 9E is a diagram illustrating the movements of the focal point.

When the experiment is conducted on the assumption that the value of the phase change intervals REP is 0, a process illustrated in FIG. 8 is not actually performed with the REP value set to 0. The experiment conducted on the assumption that the value of the phase change intervals REP is 0 is a conventional experiment that is different from the present embodiment. In such a conventional experiment, the Tnew values of all ultrasonic transducers 42 whose Ttmp and Tnew are different from each other are changed totally at one time from an old Tnew value to a new Tnew value immediately after the new Tnew value is acquired.

When the length of time of the frame is 15 ms, that is, when the frame rate is 66.66 . . . Hz, the focal point moves between 33 equally-spaced points along the trajectory K at one-frame intervals.

Further, the Rion NL-52 noise level meter 70 was disposed at the same height as the transducer array 40 and at a distance of 20 cm from the transducer array 40. Noise measurements were made with this noise level meter 70.

FIG. 8 illustrates the results of the experiment. In FIG. 8, the horizontal axis represents the frame rate, and the vertical axis represents a noise level measured by the noise level meter 70. Lines 80 to 88 indicate the experiment results obtained by using the same phase change intervals REP. Line 89 indicates a noise level that was measured with the noise level meter 70 when the ultrasonic wave focusing apparatus 1 was not operated.

As indicated in FIG. 8, the present embodiment achieves a higher level of noise reduction than a conventional example 80 when almost all combinations of frame rate and phase change intervals REP are used. Further, when the frame rate is lower than 333 Hz (the frame length is more than 3 ms), the effect of noise reduction is more remarkable than when the frame rate is not lower than 333 Hz. Furthermore, when the frame rate is not higher than 100 Hz (the frame length is not less than 10 ms), the effect of noise reduction is more remarkable than when the frame rate is higher than 100 Hz.

Moreover, the overall results in FIG. 8 indicate that the effect of noise reduction tends to increase with an increase in the phase change intervals REP.

However, when the phase change intervals REP is 5 or longer, the auditory perception of the inventors who conducts the experiment indicates that the amount of high-pitch uncomfortable noise is likely to increase with an increase in the phase change intervals REP. It is probably because the sound generated by a phase change is within the human audible range as mentioned earlier.

As the experiment results are as described above, the effect of noise reduction is achieved when the phase change intervals REP are 1 or longer. The average amount of phase change per cycle by ultrasonic vibration during a change period required for the Ttmp value to reach a newly changed Tnew value is $2\pi/REP\times 1/32$ [rad]. Thus, the effect of noise reduction is achieved as far as the average amount of phase change per cycle by ultrasonic vibration is not more than $\pi/16$ [rad]. Further, when REP is not more than 4, that is, when the average amount of phase change per cycle by ultrasonic vibration is not more than $\pi/64$ [rad], the possibility of a phase change generating a sound within the human audible range is greatly reduced. Therefore, it is obvious that an increased effect of noise reduction is achieved.

The REP setting is limited by the frame rate. The average amount of phase change per cycle of an ultrasonic wave decreases with an increase in the REP setting. In order to surely complete the movement of the focal point within the length of one frame in a situation where the length of one frame is Tf and the length of time of one ultrasonic wave cycle is Ts, it is preferable that the average amount of phase change per cycle of an ultrasonic wave be not smaller than $2\pi\times Ts/Tf$ [rad]. If, for example, Tf=1 ms and Ts=25 μs, it is preferable that the average amount of phase change per cycle of an ultrasonic wave be not smaller than $\pi/20$ [rad].

The result of simulation of focal point movement in the present embodiment will now be described. In the experiment for the simulation, it is assumed that the time lag Tnew and the time lag Ttmp are variable in increments of 25/32 μs, which is obtained by dividing the ultrasonic vibration cycle of an ultrasonic transducer 42 by 32. Therefore, Tnew and Ttmp vary in steps of 25/32 μs. Further, Ttmp and Tnew take an integer value between 0 and 31.

As illustrated in FIGS. 9A to 9E, the simulation is conducted by moving the focal point G from an initial position (X, Y, Z)=(−7 mm, 0 mm, 150 mm) to a target position (X, Y, Z)=(7 mm, 0 mm, 150 mm) on a plane (Z=150 mm) that is positioned parallel to and at a predetermined distance from the circuit board 41 of the transducer array 40.

More specifically, the calculation portion 14 of the instruction input device 10 outputs the initial position as the three-dimensional position coordinates of the ultrasonic wave focal point, the control device 20 then changes the phase accordingly in multiple steps to move the focal point to the initial position, and the calculation portion 14 eventually outputs the target position.

Consequently, the sound pressure on the plane (Z=150 mm) changes with time in the order of FIGS. 9A to 9E. The value T in each of FIGS. 9A to 9E represents the elapsed time from a state where the focal point is forming at the initial position, and is variable in increments of one ultrasonic wave cycle. Further, FIGS. 9A to 9E indicate the sound pressure by using the density of white spots. As indicated in FIGS. 9A to 9E, the focal point does not move gradually in small steps from the initial position to the target position. Instead, the sound pressure of the focal point at the initial position gradually decreases while the focal point is fixed at the initial position, and at the same time, the sound pressure of a new focal point at the target position gradually increases while the new focal point is fixed at the target position. In short, the focal point jumps from the initial position to the target position.

Second Embodiment

A second embodiment of the present invention will now be described. The ultrasonic wave focusing apparatus 1 according to the second embodiment differs from the ultrasonic wave focusing apparatus 1 according to the first embodiment in the waveform generation process performed by the waveform generation unit 24.

Figure 10:
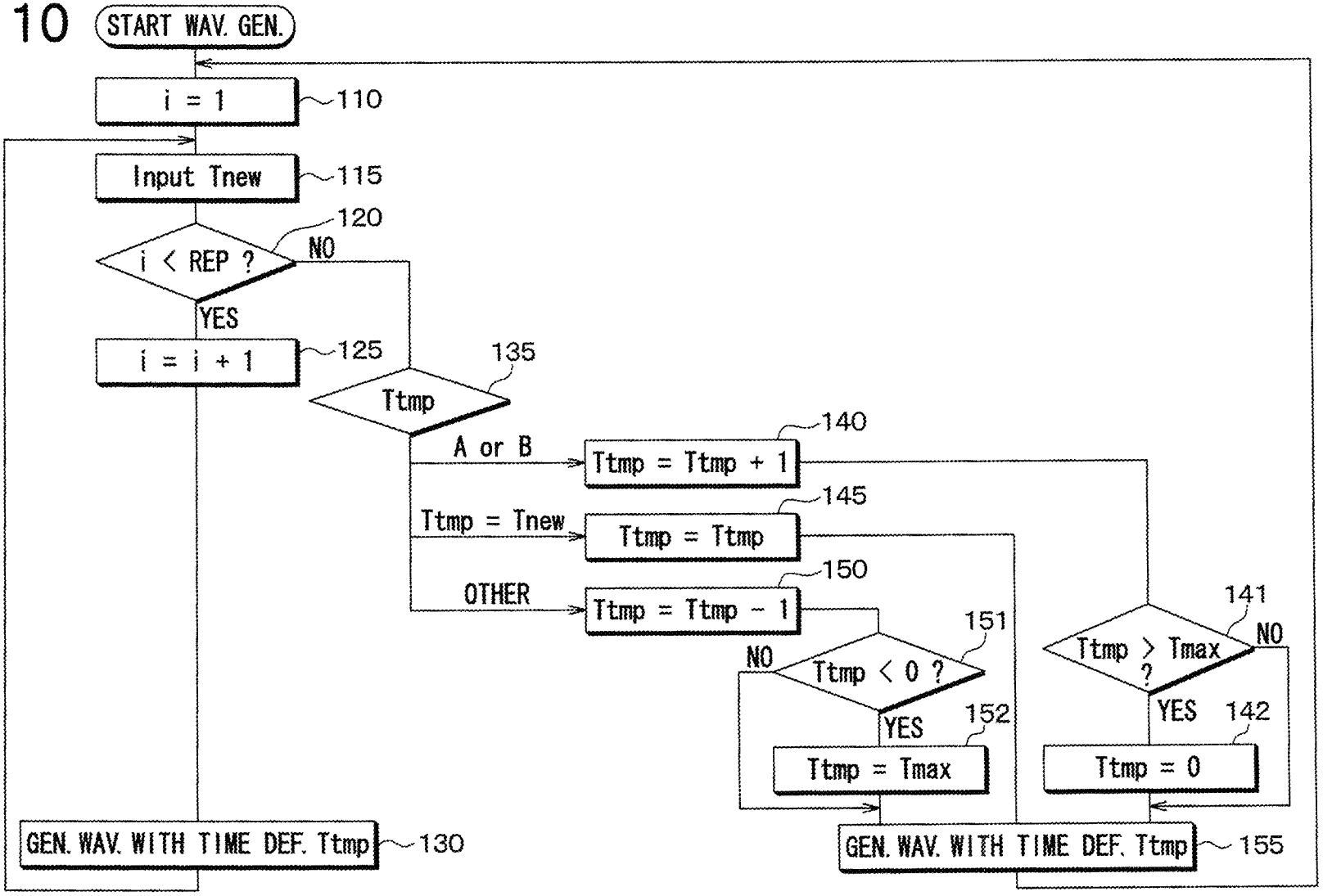
FIG. 10 is a flowchart illustrating the waveform generation process according to a second embodiment of the present invention.

FIG. 10 is a flowchart illustrating the waveform generation process according to the second embodiment. The waveform generation process illustrated in FIG. 10 differs from the waveform generation process illustrated in FIG. 5 in that the determination in step 135 is changed, and that steps 141 and 142 are added between steps 140 and 155, and further that steps 151 and 152 are added between steps 150 and 155. Steps 110, 115, 120, 125, 130, 140, 145, 150, and 155 in FIG. 10 are the same as the corresponding steps of the waveform generation process illustrated in FIG. 5.

In the waveform generation process illustrated in FIG. 10, the waveform generation unit 24 determines in step 135 whether either of conditions A and B is satisfied by the value of current time lag Ttmp. If either condition A or condition B is satisfied, the waveform generation unit 24 proceeds to step 140 and determines whether Ttmp=Tnew. If Ttmp=Tnew, the waveform generation unit 24 proceeds to step 145. If, by contrast, Ttmp is not equal to Tnew, waveform generation unit 24 proceeds to step 150.

Details of conditions A and B and the meaning of the determination in step 135 will now be described with reference to FIG. 11. When the phase of an ultrasonic transducer is to be shifted by one increment of Ttmp in multiple steps, the phase is changed in either a phase advance mode or a phase retard mode, whichever will provide a phase difference corresponding to Tnew through a smaller number of steps. The + and − signs in FIG. 11 indicate whether Ttmp is to be increased (to advance the phase) or decreased (to retard the phase).

Condition A is Tnew−Tmid<Ttmp<Tnew. Condition B is Tnew+Tmid<Ttmp. Tmid is half the maximum value Tmax of Ttmp and Tnew.

Figure 11:
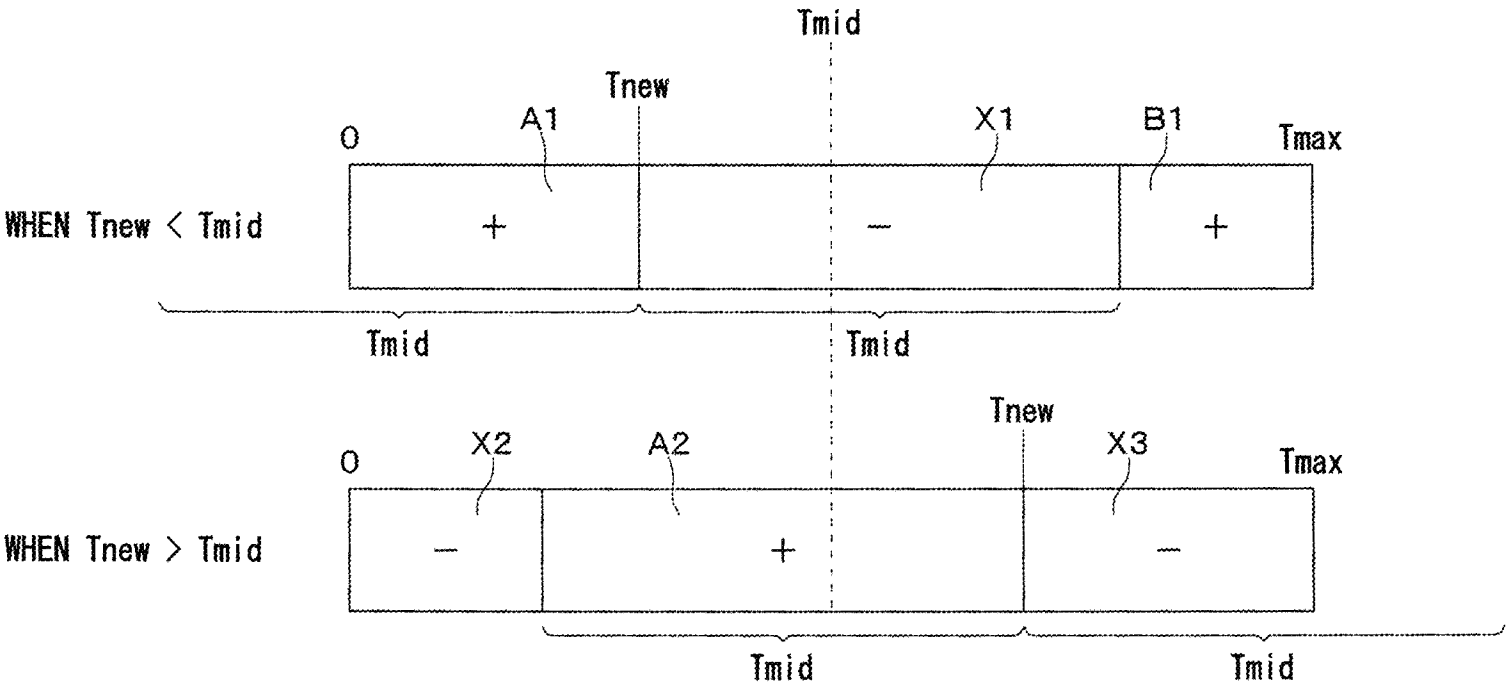
FIG. 11 is a diagram illustrating the relationship between the value of Ttmp and its increase and decrease.

If Tnew<Tmid within a range A1 where Ttmp is smaller than Tnew, as indicated in the upper half of FIG. 11, the phase is advanced in a direction of increasing Ttmp. The reason is that, within the range A1, Tnew is reached through a smaller number of steps when the value of Ttmp is incremented by one than when the value of Ttmp is decremented by one until it reaches 0 (zero), then increased to Tmax in the next step, and further decremented by one. If Tnew<Tmid, the range A1 satisfies condition A because Tnew−Tmid is a minus value.

If Tnew<Tmid within a range B1 where Ttmp is greater than Tmid+Tnew, as indicated in the upper half of FIG. 11, the phase is advanced in a direction of increasing Ttmp. The reason is that, within a range A2, Tnew is reached through a smaller number of steps when the value of Ttmp is incremented by one until it reaches Tmax, then decreased to 0 (zero) in the next step, and further incremented by one than when the value of Ttmp is decremented by one. The range B1 satisfies condition B because Ttmp is greater than Tmid+Tnew.

If Tnew<Tmid within a range X1 where Ttmp is greater than Tnew and not greater than Tnew+Tmid, as indicated in the upper half of FIG. 11, the phase is advanced in a direction of decreasing Ttmp. The reason is that, within the range X1, a comparison between a method of decrementing the value of Ttmp by one and a method of incrementing the value of Ttmp by one until it reaches Tmax, then decreasing the value of Ttmp to 0 (zero) in the next step, and further incrementing the value of Ttmp by one indicates that the former method reaches Tnew through a smaller number of steps than the latter method, or that the two methods reach Tnew through the same number of steps. The range X1 satisfies neither condition A nor condition B. Further, Ttmp is not equal to Tnew within the range X1.

If Tnew>Tmid within the range A2 where Ttmp is greater than Tnew−Tmid, as indicated in the lower half of FIG. 11, the phase is advanced in a direction of increasing Ttmp. The reason is that, within the range A2, Tnew is reached through a smaller number of steps when the value of Ttmp is incremented by one than when the value of Ttmp is decremented by one until it reaches 0 (zero), then increased to Tmax in the next step, and further decremented by one. The range A2 satisfies condition A.

If Tnew>Tmid within a range X2 where Ttmp is not greater than Tnew−Tmid, as indicated in the lower half of FIG. 11, the phase is advanced in a direction of decreasing Ttmp. The reason is that, within the range X2, a comparison between a method of decrementing the value of Ttmp by one until it reaches 0 (zero), then increasing the value of Ttmp to Tmax in the next step, and further decrementing the value of Ttmp by one and a method of incrementing the value of Ttmp by one indicates that the former method reaches Tnew through a smaller number of steps than the latter method, or that the two methods reach Tnew through the same number of steps. The range X2 satisfies neither condition A nor condition B because Ttmp is not greater than Tmid−Tnew. Further, Ttmp is not equal to Tnew within the range X2.

If Tnew<Tmid within a range X3 where Ttmp is greater than Tnew, as indicated in the lower half of FIG. 11, the phase is advanced in a direction of decreasing Ttmp. The reason is that, within the range X3, Tnew is reached through a smaller number of steps when the value of Ttmp is decremented by one than when the value of Ttmp is incremented by one until it reaches Tmax, then decreased to 0 (zero) in the next step, and further incremented by one. The range X3 satisfies neither condition A nor condition B. Further, Ttmp is not equal to Tnew within the range X3.

Returning to the description of the process illustrated in FIG. 10, after Ttmp is increased by one in step 140, processing proceeds to step 141 and determines whether Ttmp is greater than Tmax. If it is determined that Ttmp is greater than Tmax, processing proceeds to step 142 and sets the value of Ttmp to 0 (zero). Upon completion of step 142, processing proceeds to step 155. When Ttmp is increased from Tmax, Ttmp is set to 0 (zero) in step 142 as described above. As described earlier, changing Ttmp from Tmax to 0 (zero) is equivalent to shifting the phase of an ultrasonic transducer by one step. If it is determined in step 141 that Ttmp is not greater than Tmax, processing skips step 142 and then proceeds to step 155.

Further, after Ttmp is decreased by one in step 150, processing proceeds to step 151 and determines whether Ttmp is smaller than 0 (zero). If it is determined that Ttmp is smaller than 0 (zero), processing proceeds to step 152 and sets the value of Ttmp to Tmax. Upon completion of step 152, processing proceeds to step 155. As the above operation is performed, if Ttmp is decreased from 0 (zero), Ttmp is set to Tmax in step 152. As described earlier, changing Ttmp from 0 (zero) to Tmax is equivalent to shifting the phase of an ultrasonic transducer by one step. If it is determined in step 151 that Ttmp is not smaller than 0 (zero), processing skips step 142 and then proceeds to step 155.

In the present embodiment, it is assumed that the time lag Tnew and the time lag Ttmp are variable in increments of 25/32 μs, which is obtained by dividing the ultrasonic vibration cycle of an ultrasonic transducer 42 by 32. Therefore, Tnew and Ttmp vary in steps of 25/32 s. Further, Ttmp and Tnew take an integer value between 0 and 31.

The method according to the present embodiment also achieves noise reduction, as is the case with the method according to the first embodiment. When the inputted position coordinates within a space are changed, the control device 20 according to the present embodiment examines the ultrasonic transducers 42 to locate a particular ultrasonic transducer 42 having the target value Tnew different from the current value Ttmp corresponding to the current phase of an outputted ultrasonic wave, and changes the phase of an ultrasonic wave outputted from the particular ultrasonic transducer 42 to the target phase in multiple steps in either the phase advance mode or the phase retard mode, whichever will provide the target phase through a smaller number of steps.

As the present embodiment is configured as described above, it is possible to shorten the period required to complete a phase change for all ultrasonic transducers 42. Further, when the above operation is performed, the control device 20 can advance the phase of some ultrasonic transducers 42 and, at the same time, retard the phase of some other ultrasonic transducers 42.

Figure 12A:
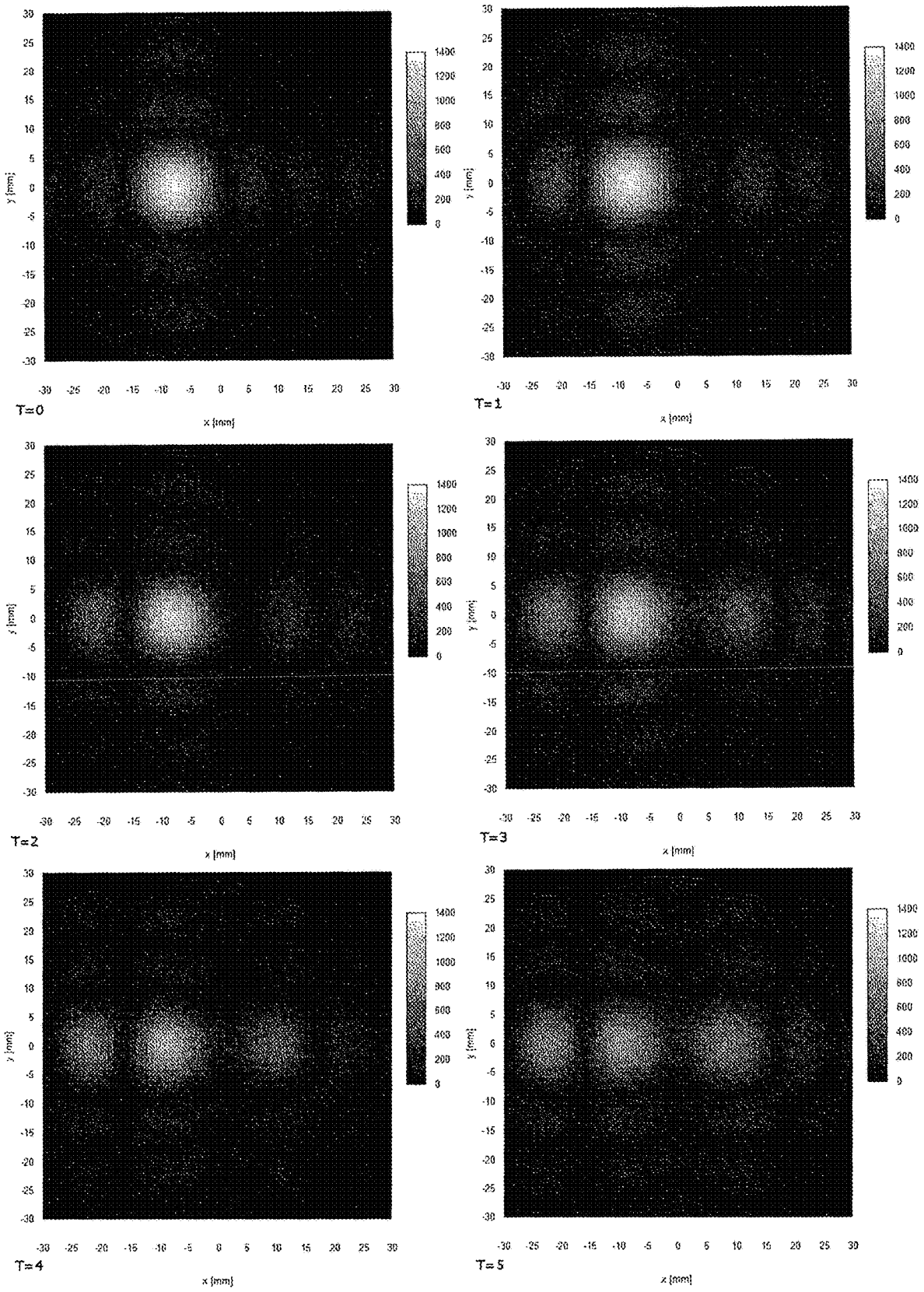
FIG. 12A is a diagram illustrating the movements of the focal point.
Figure 12B:
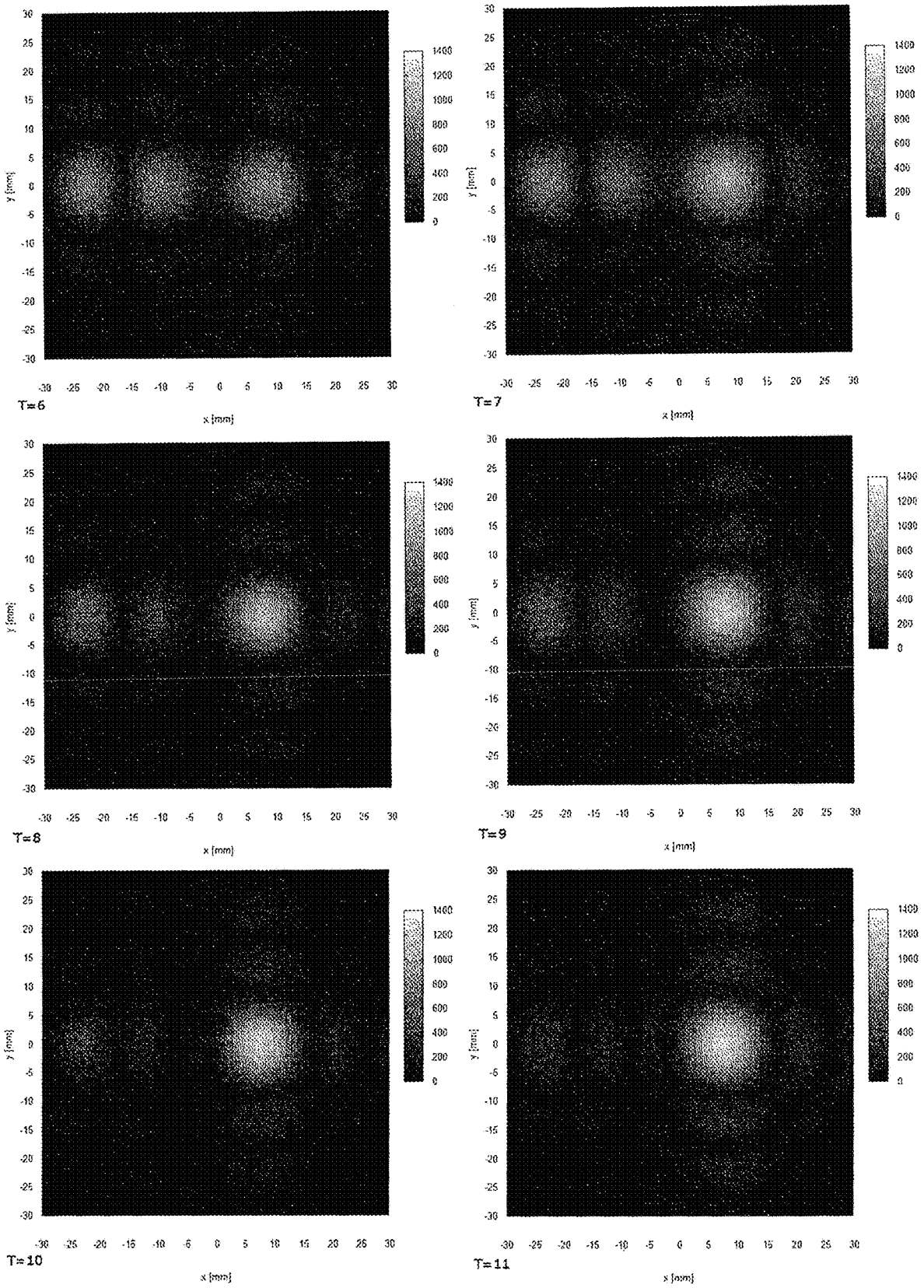
FIG. 12B is a diagram illustrating the movements of the focal point.
Figure 12C:
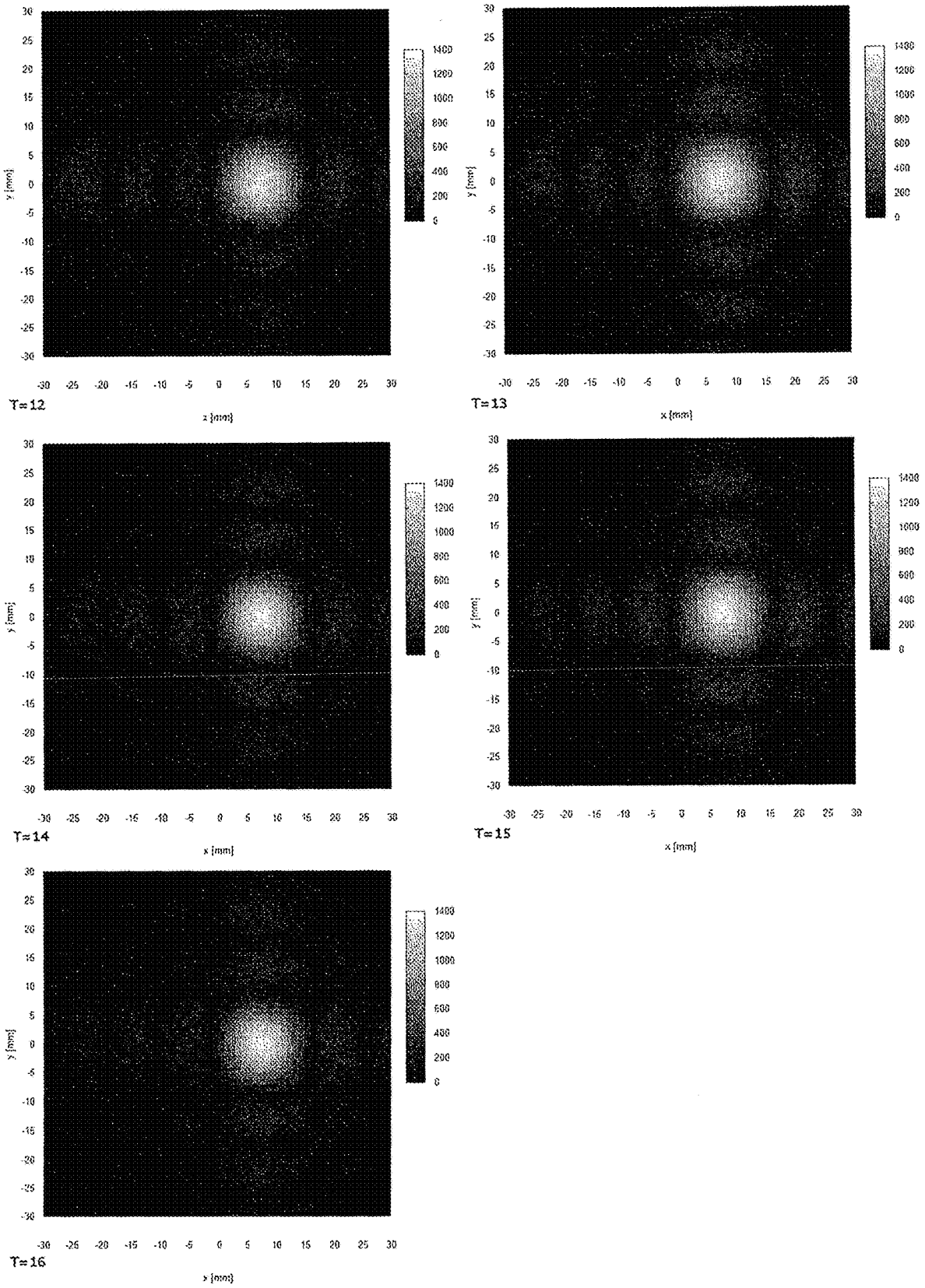
FIG. 12C is a diagram illustrating the movements of the focal point.

The result of simulation of focal point movement in the present embodiment will now be described. As illustrated in FIGS. 12A to 12C, the simulation is conducted by moving the focal point G from an initial position (X, Y, Z)=(−7 mm, 0 mm, 150 mm) to a target position (X, Y, Z)=(7 mm, 0 mm, 150 mm) on a plane (Z=150 mm) that is positioned parallel to and at a predetermined distance from the circuit board 41 of the transducer array 40.

More specifically, the calculation portion 14 of the instruction input device 10 outputs the initial position as the three-dimensional position coordinates of the ultrasonic wave focal point, the control device 20 then changes the phase accordingly in multiple steps to move the focal point to the initial position, and the calculation portion 14 eventually outputs the target position.

Consequently, the sound pressure on the plane (Z=150 mm) changes with time in the order of FIGS. 12A to 12C. The value T in each of FIGS. 12A to 12C represents the elapsed time from a state where the focal point is formed at the initial position, and is variable in increments of one ultrasonic wave cycle. FIGS. 12A to 12C indicate the sound pressure by using the density of white spots. As indicated in FIGS. 12A to 12C, the focal point does not move gradually in small steps from the initial position to the target position. Instead, the sound pressure of the focal point at the initial position gradually decreases while the focal point is fixed at the initial position, and at the same time, the sound pressure of a new focal point at the target position gradually increases while the new focal point is fixed at the target position. In short, the focal point jumps from the initial position to the target position.

Other Embodiments

The present invention is not limited to the foregoing embodiments, but extends to various modifications that fall within the scope of the appended claims. It is obvious that elements in the foregoing embodiments are not always essential unless they are, for example, expressly defined as being essential or obviously essential from a theoretical point of view. Also, when numerical values of the elements in the foregoing embodiments, including the number of pieces, amounts, and ranges, are referred to in the description of the foregoing embodiments, the numerical values are not limited to a specific number unless they are, for example, expressly defined as being essential or obviously limited to the specific number from a theoretical point of view. Similarly, when, for example, the shapes of or the positional relationship between the elements are referred to in the description of the foregoing embodiments, the elements are not limited to the shapes or the positional relationship unless they are expressly defined or theoretically limited, for example, to a particular shape or positional relationship. Further, the present invention permits the following modifications of the foregoing embodiments. Selection can be made so that the following modifications are either applied or unapplied to the foregoing embodiments on an individual basis. More specifically, any combinations of the following modifications can be applied to the foregoing embodiments.

(First Modification)

In the foregoing embodiments, the waveform generation unit 24 changes the phase Ttmp of vibration outputted from an ultrasonic transducer 42 to the target phase Tnew gradually in multiple steps and not totally at one time. However, the purpose of the present invention may alternatively be achieved by changing the phase continuously instead of changing the phase in multiple steps.

(Second Modification)

In the foregoing embodiments, each drive signal inputted from the waveform generation unit 24 to the amplifier 30 is AM-modulated by the Enable signal and inputted to a respective ultrasonic transducer 42. Thus, the ultrasonic vibration outputted from the transducer array 40 is able to stimulate human tactile perception. However, when the ultrasonic wave focusing apparatus 1 is not used in an application where human perception need not be stimulated, the modulation unit 22 need not always be included in the configuration.

Even when the modulation unit 22 is excluded from the configuration, the ultrasonic vibration outputted from the transducer array 40 stimulates human tactile perception as far as the sound pressure P is gradually changed (e.g., at a frequency of 1 to 1023 Hz).

(Third Modification)

In the foregoing embodiments, the same threshold value REP is used in all the waveform generation processes. Therefore, for all the ultrasonic transducers 42, the time lag Ttmp can be changed only once at the same intervals of cycles. Alternatively, however, the timing for changing the time lag Ttmp may be different from the above.

For example, the time lag Ttmp for a certain ultrasonic transducer 42 may be changed by one step at one-cycle intervals, that is, changed by a total of eight increments while the time lag Ttmp for another ultrasonic transducer 42 is changed by one step at two-cycle intervals, that is, changed by a total of four increments. That is to say, the setting of the threshold value REP may vary from one ultrasonic transducer 42 to another. In such an instance, each threshold value REP may be set so that the current time lag Ttmp reaches the target time lag Tnew at the same time in a plurality of ultrasonic transducers 42 having the current time lag Ttmp that differs from the target time lag Tnew as a result of a change in the three-dimensional position coordinates X, Y, Z.

(Fourth Modification)

In the foregoing embodiments, the control device 20 changes the current time lag Ttmp at intervals of an integer multiple of 25 μs, which is one cycle of ultrasonic vibration. However, a method other than the above may be employed. For example, an alternative is to change the time lag Ttmp at intervals of "other than an integer multiple of one cycle (e.g., at intervals of 12.5 μs, which is obtained by multiplying 25 μs by 0.5)." Another alternative is to change the time lag Ttmp at "irregularly varying time intervals (e.g., at intervals of a mixture of one cycle and two cycles or at random intervals including intervals of other than an integer multiple of one cycle)."

When, as described above, the time lag Ttmp changes by one step at time intervals obtained by multiplying one cycle by 0.5, the average amount of phase change per cycle of an ultrasonic wave is $\pi/4$ [rad]. Therefore, the average amount of phase change per cycle of an ultrasonic wave may be not smaller than $\pi/32$ [rad] and not larger than $\pi/4$ [rad] although it is not smaller than $\pi/32$ [rad] and not larger than $\pi/8$ [rad] in the foregoing embodiments.

(Fifth Modification)

In the foregoing embodiments, the time lag Ttmp and the time lag Tnew are variable in increments of 25/16 μs, which is the length of time obtained by dividing the cycle of ultrasonic vibration of an ultrasonic transducer 42 by 16, or in increments of 25/32 μs, which is obtained by dividing the ultrasonic vibration cycle of an ultrasonic transducer 42 by 32.

However, the time lag Ttmp and the time lag Tnew may alternatively be variable in increments of 25/48 μs, which is the length of time obtained by dividing the cycle of ultrasonic vibration of an ultrasonic transducer 42 by 48. That is to say, the phase may be variable in increments determined by dividing the cycle of ultrasonic vibration of an ultrasonic transducer 42 by an integer of 2 or greater.

(Sixth Modification)

In the foregoing embodiments, the amplifier 30 modulates each drive signal by multiplying each drive signal by the Enable signal, which is a rectangular wave inputted from the modulation unit 22. Alternatively, however, the amplifier 30 may be substituted by an amplification device that inputs an audio signal, which varies gradually (or in multiple steps of 2 or more bits), and changes the waveform of each drive signal gradually (or in multiple steps of 2 or more bits) by multiplying each drive signal by the audio signal.

(Seventh Modification)

In the foregoing embodiments, each drive signal is modulated by an AM modulation method. Alternatively, however, each drive signal may be modulated by an FM or other modulation method.

(Eighth Modification)

In the foregoing embodiments, the transducer array 40 allows ultrasonic waves to Balm only one focal point. However, the number of focal points to be formed is not limited to one. For example, the transducer array 40 may allow the ultrasonic waves to form a plurality of discrete focal points or form a focal region that is shaped and stretched due to the interference of ultrasonic waves.

LIST OF REFERENCE SIGNS

1 . . . Ultrasonic wave focusing apparatus
10 . . . Instruction input device

20 . . . Control device
30 . . . Amplifier
40 . . . Transducer array
42 . . . Ultrasonic transducer

The invention claimed is:

1. An ultrasonic wave focusing apparatus comprising:

a transducer array having a plurality of ultrasonic transducers; and a control device to which position coordinates within a space are inputted, the control device causing the ultrasonic transducers to generate ultrasonic waves having phases based on the position coordinates in such a manner that the ultrasonic waves of the ultrasonic transducers form a focal point at the position coordinates, wherein, when the inputted position coordinates within the space are changed discretely in a trajectory from a first position to a second position that is adjacent to the first position, the control device calculates a target value for each target phase necessary for the ultrasonic waves outputted from the ultrasonic transducers to form a focal point at the second position, locates an ultrasonic transducer whose current value for a current phase of an outputted ultrasonic wave is different from the target value, and changes a phase of an ultrasonic wave outputted from the ultrasonic transducer to its target phase in multiple steps.

2. The ultrasonic wave focusing apparatus according to claim 1, wherein, when the inputted position coordinates within the space are changed, the control device calculates a target value for each target phase necessary for the ultrasonic waves outputted from the ultrasonic transducers to form a focal point at the changed position coordinates, locates an ultrasonic transducer whose current value for a current phase of an outputted ultrasonic wave is different from the target value, and changes a phase of an ultrasonic wave outputted from the located ultrasonic transducer to its target phase in multiple steps by one step at intervals of multiple cycles of ultrasonic vibration outputted from the located ultrasonic transducer.

3. The ultrasonic wave focusing apparatus according to claim 2, wherein the multiple cycles are not more than 50 μs in length.

4. The ultrasonic wave focusing apparatus according to claim 1, wherein, when the inputted position coordinates within the space are changed, the control device locates an ultrasonic transducer whose current value is different from the target value and changes a phase of an ultrasonic wave outputted from the located ultrasonic transducer to its target phase in multiple steps in either a phase advance mode or a phase retard mode based on whether the phase advance mode or the phase retard mode provides the target phase through a smaller number of steps.

5. The ultrasonic wave focusing apparatus according to claim 1, wherein, when the inputted position coordinates within the space are changed from an initial position to a target position, the control device locates an ultrasonic transducer whose current value is different from the target value and changes the phase of an ultrasonic wave outputted from the located ultrasonic transducer to its target phase in multiple steps or continuously in order to gradually decrease a sound pressure at the initial position while fixing the focal point at the initial position, and at the same time, gradually increase a sound pressure at the target position while fixing the new focal point at the target position.

6. The ultrasonic wave focusing apparatus according to claim 1, wherein, when the inputted position coordinates within the space are changed, the control device locates an ultrasonic transducer whose current value is different from the target value and changes a phase of an ultrasonic wave outputted from the located ultrasonic transducer to the target phase in multiple steps or continuously while ensuring that the average amount of phase change per cycle of the outputted ultrasonic wave is not larger than $\pi/4$ [rad].

7. The ultrasonic wave focusing apparatus according to claim 1, wherein, when the inputted position coordinates within the space are changed, the control device locates an ultrasonic transducer whose current value is different from the target value and changes a phase of an ultrasonic wave outputted from the located ultrasonic wave outputted from the located ultrasonic transducer to consistently become closer to the target phase.

8. The ultrasonic wave focusing apparatus according to claim 1, wherein the control device changes the phase of the ultrasonic wave outputted from the located ultrasonic transducer to its target phase in multiple steps by one step at intervals of multiple cycles of ultrasonic vibration outputted from the located ultrasonic transducer, and the control device changes the phase of the ultrasonic wave outputted from the located ultrasonic transducer to its target phase in multiple steps in order to gradually decrease a sound pressure at the initial position while fixing the focal point at the initial position, and at the same time, gradually increase a sound pressure at the target position while fixing the new focal point at the target position.

9. The ultrasonic wave focusing apparatus according to claim 8, wherein the multiple cycles are not more than 50 μs in length.

10. The ultrasonic wave focusing apparatus according to claim 9, wherein the control device changes the phase of the ultrasonic wave outputted from the located ultrasonic transducer to its target phase in multiple steps in either a phase advance mode or a phase retard mode based on whether the phase advance mode or the phase retard mode provides the target phase through a smaller number of steps.

* * * * *